US009360821B2

(12) United States Patent
Katayama

(10) Patent No.: US 9,360,821 B2
(45) Date of Patent: Jun. 7, 2016

(54) IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Junichi Katayama, Kanagawa-ken (JP)

(73) Assignees: TOSHIBA TEC KABUSHIKI KAISHA, Tokyo (JP); KABUSHIKI KAISHA TOSHIBA, Tokyo (JP)

( * ) Notice: Subject to any disclaimer, the term of this patent is extended or adjusted under 35 U.S.C. 154(b) by 30 days.

(21) Appl. No.: 14/168,119

(22) Filed: Jan. 30, 2014

(65) Prior Publication Data

US 2014/0255056 A1 Sep. 11, 2014

(30) Foreign Application Priority Data

Mar. 6, 2013 (JP) ..... 2013-43940

(51) Int. Cl.
*G03G 15/00* (2006.01)
*G03G 15/08* (2006.01)

(52) U.S. Cl.
CPC ..... *G03G 15/6585* (2013.01); *G03G 15/0831* (2013.01); *G03G 2215/0141* (2013.01)

(58) Field of Classification Search
CPC ..... G03G 15/0831; G03G 15/556; G03G 2215/0888; G03G 15/50
USPC ..... 399/28, 82, 85
See application file for complete search history.

(56) References Cited

U.S. PATENT DOCUMENTS

2005/0219602 A1* 10/2005 Mikami ..... 358/1.14
2010/0033743 A1 2/2010 Hirai

FOREIGN PATENT DOCUMENTS

| | | | |
|---|---|---|---|
| JP | 07234617 A | * | 9/1995 |
| JP | 10-171198 | | 6/1998 |
| JP | 2005-311480 | | 11/2005 |
| JP | 2007-140145 | | 6/2007 |
| JP | 2010-042521 | | 2/2010 |
| JP | 2010-115852 | | 5/2010 |

OTHER PUBLICATIONS

Minamino (JP 2010-115852 A), May 2010, JPO Computer Translation.*
Office Action of Notice of Reasons for Refusal for Japanese Patent Application No. 2013-043940 Dated Sep. 16, 2014, 9 pages.

* cited by examiner

*Primary Examiner* — Erika J Villaluna
(74) *Attorney, Agent, or Firm* — Amin, Turocy & Watson LLP; Gregory Turocy

(57) ABSTRACT

According to an embodiment, there is provided an image forming apparatus that forms a color image using a plurality of discolorable coloring materials and a plurality of non-discolorable coloring materials. In a case where insufficiency of at least one coloring material from among the plurality of discolorable coloring materials and the plurality of non-discolorable coloring materials is detected, the image forming apparatus performs color image formation using the plurality of discolorable coloring materials and the plurality of non-discolorable coloring material in combination.

6 Claims, 10 Drawing Sheets

IMAGE FORMING APPARATUS

CROSS-REFERENCE TO RELATED APPLICATION

This application is based upon and claims the benefit of priority from the prior Japanese Patent Application No. 2013-43940, filed on Mar. 6, 2013, the entire contents of which are incorporated herein by reference.

FIELD

Generally, embodiments described here relate to an image forming apparatus.

BACKGROUND

Image forming apparatuses that form images using erasable coloring materials have been put into practical use. As the erasable coloring materials, coloring materials are known that become transparent by being heated. For example, an image forming apparatus forms an erasable full-color image by using erasable coloring materials of black (BK), cyan (C), magenta (M), and yellow (Y).

The above-described image forming apparatus cannot form an image when the coloring materials are insufficient. For example, in the image forming apparatus, an image forming operation is stopped even when only one of the coloring materials out of the erasable coloring materials of BK, C, M, and Y is insufficient.

DETAILED DESCRIPTION

Figure 1:
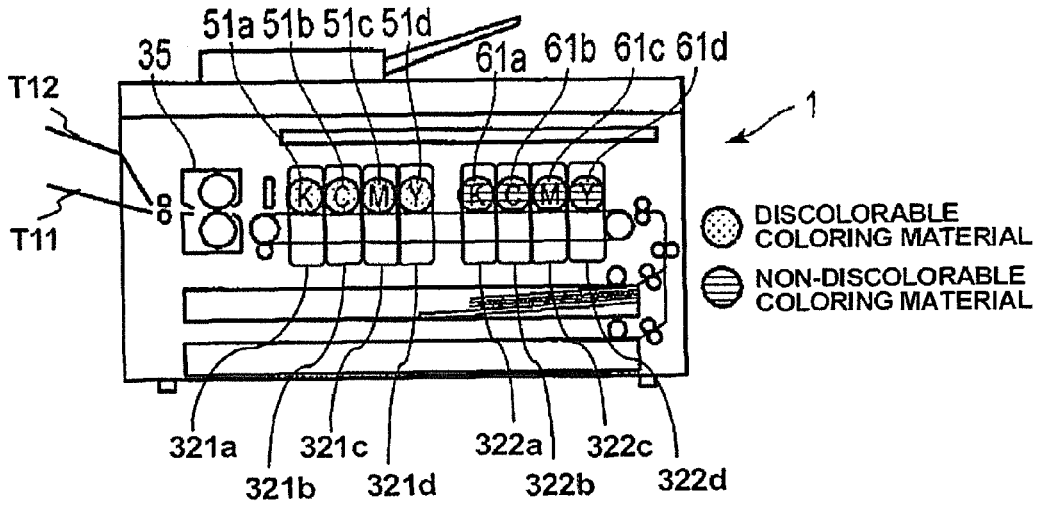
FIG. 1 is a diagram illustrating a main part of an image forming apparatus according to a first embodiment.

According to an embodiment, an image forming apparatus includes an image forming unit, a detection unit, and a control unit. The image forming unit selectively performs a first image forming mode in which a color image is formed by using discolorable coloring materials of a plurality of colors, a second image forming mode in which a color image is formed by using non-discolorable coloring materials of a plurality of colors, and a third image forming mode in which a color image is formed by using the discolorable coloring materials of the plurality of colors and the non-discolorable coloring materials of the plurality of colors in combination. The detection unit detects whether or not residual amounts of the discolorable coloring materials of the plurality of colors and the non-discolorable coloring materials of the plurality of colors of the image forming unit are insufficient. The control unit controls color image formation of the third image forming mode by the image forming unit in a case where the detection unit detects insufficiency of a residual amount of the discolorable coloring material of at least one color from among the discolorable coloring materials of the plurality of colors or the non-discolorable coloring material of at least one color from among the non-discolorable coloring materials of the plurality of colors.

Hereinafter, an embodiment will be described with reference to the drawings. In the drawings, like reference numerals denote like or similar elements.

An image forming apparatus according to a first embodiment will be described with reference to FIGS. 1 to 3 and FIGS. 6 to 8. An image forming apparatus 1 according to the first embodiment is a multi-function peripheral (MFP). Hereinafter, the image forming apparatus 1 will be simply referred to as an MFP 1.

Figure 2:
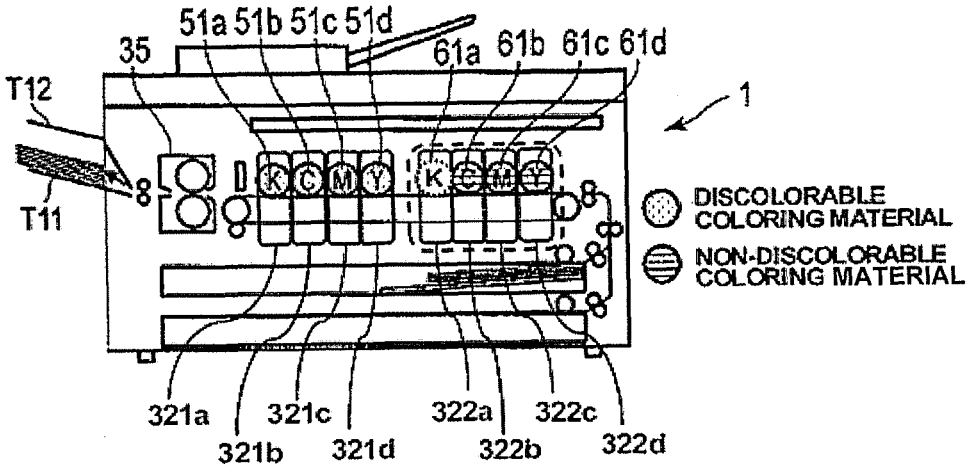
FIG. 2 is a diagram illustrating the main part of the image forming apparatus according to the first embodiment in the middle of a full-color printing of a second image forming mode.
Figure 3:
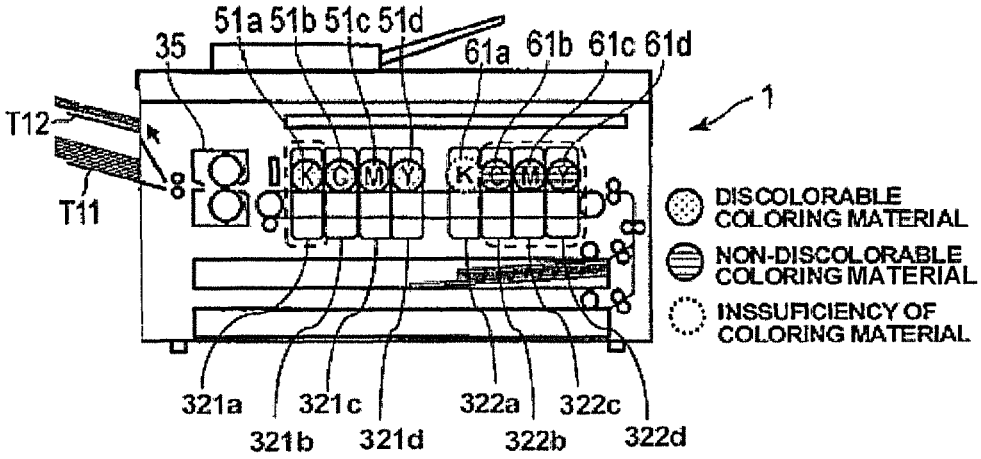
FIG. 3 is a diagram illustrating the main part of the image forming apparatus according to the first embodiment in the middle of a full-color printing of a third image forming mode.
Figure 6:
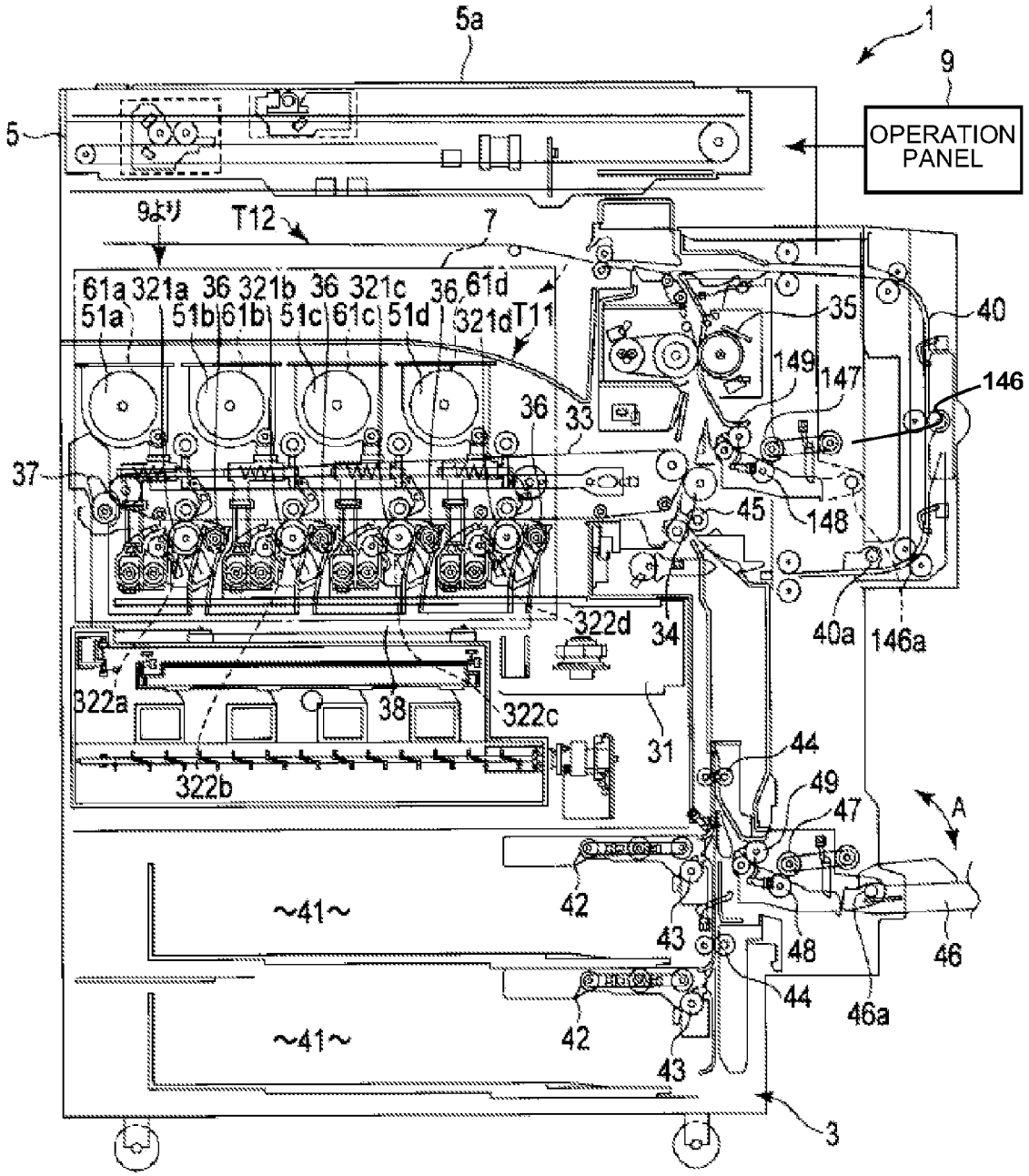
FIG. 6 is a cross-sectional view illustrating the image forming apparatus according to the first embodiment.
Figure 7:
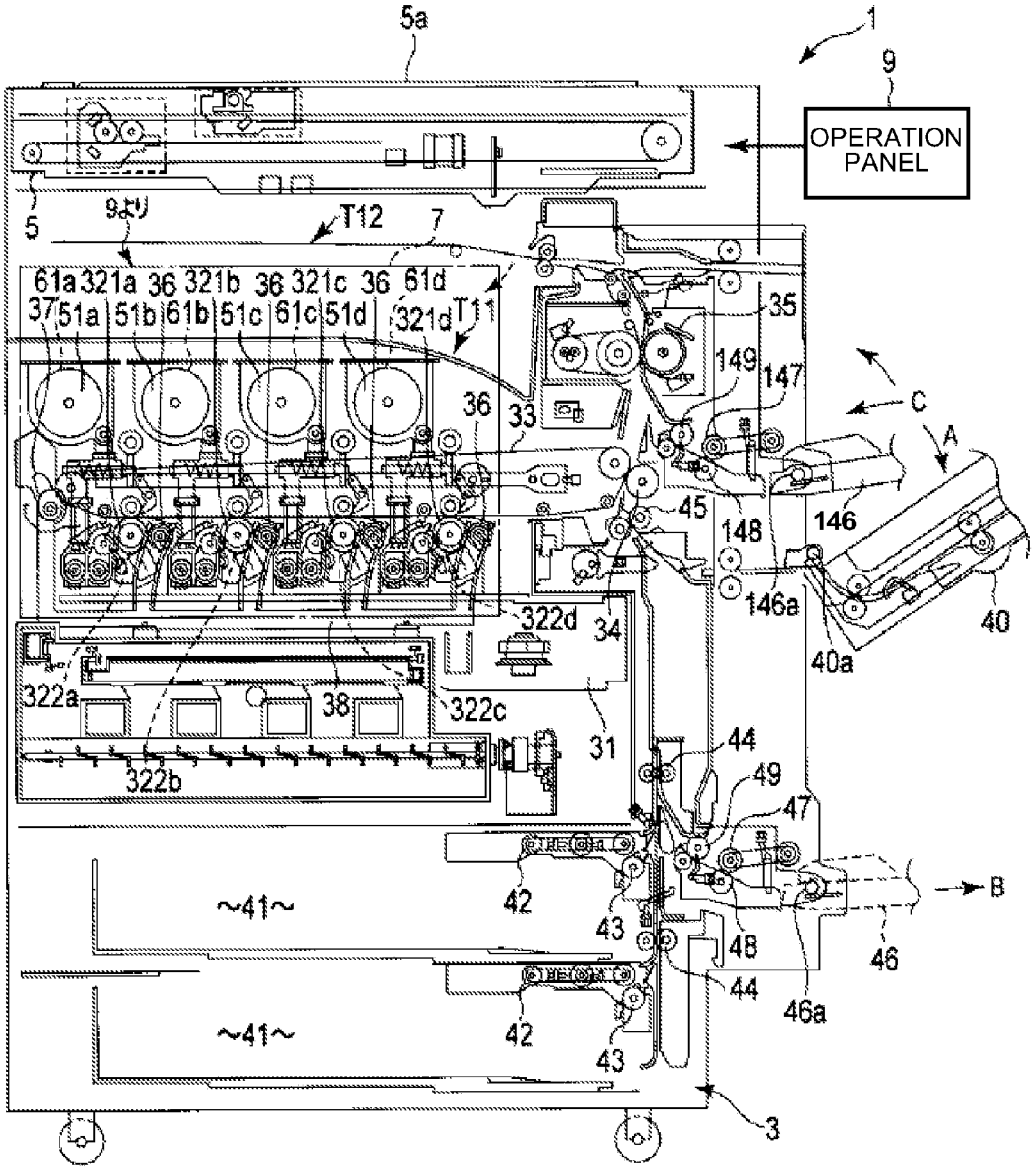
FIG. 7 is a cross-sectional view illustrating the image forming apparatus according to the first embodiment to which a manual feeding tray for an erasing operation is installed.
Figure 8:
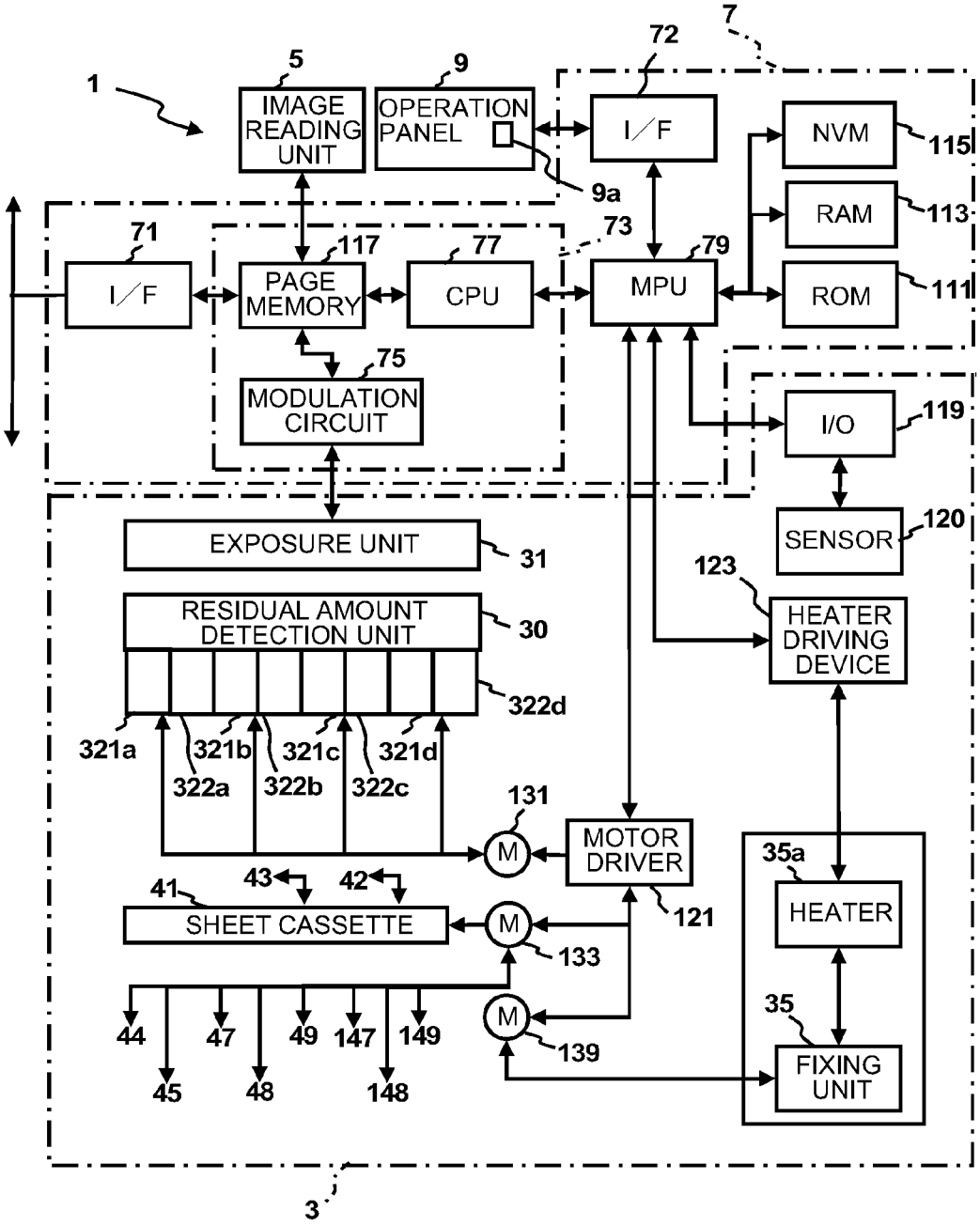
FIG. 8 is a block diagram illustrating the control configuration of the image forming apparatus according to the first embodiment.

FIG. 1 is a diagram illustrating a main part of the MFP 1 according to the first embodiment. FIGS. 2 and 3 are diagrams illustrating the main part of the MFP 1 for easy understanding the process of switching from full-color printings of first and second image forming modes to be described later to a full-color printing of a third image forming mode to be described later. More specifically, FIG. 2 is a diagram illustrating the main part of the MFP 1 in the middle of the full-color printing of the second image forming mode in the above-described switching process. FIG. 3 is a diagram illustrating the main part of the MFP 1 in the middle of the full-color printing of the third image forming mode in the above-described switching process. FIG. 6 is a cross-sectional view illustrating a specific example of the MFP 1 according to the first embodiment for realizing various processes including the above-described switching process. FIG. 7 is a cross-sectional view illustrating a state in which a manual feeding tray for an erasing operation is installed to the MFP 1 illustrated in FIG. 6. FIG. 8 is a block diagram illustrating the control configuration of the MFP 1 illustrated in FIG. 6. Although the MFP 1 illustrated in FIGS. 1 to 3 and the MFP 1 illustrated in FIGS. 6 and 7 are slightly different from each other in the outline and the internal configuration, the MFPs may be the same.

As illustrated in FIGS. 1 to 3, the MFP 1 includes a plurality of housing units that respectively house coloring materials 51*a*, 51*b*, 51*c*, 51*d*, 61*a*, 61*b*, 61*c*, and 61*d*. The housing units of the coloring materials 51*a* to 51*d* and 61*a* to 61*d* are arranged in the conveyance direction (in the figure, from the right side to the left side) of sheets. The MFP 1 includes first to eighth image forming stations 321*a*, 321*b*, 321*c*, 321*d*, 322*a*, 322*b*, 322*c*, and 322*d* that respectively form images using the coloring materials 51*a* to 51*d* and 61*a* to 61*d*. The first to eighth image forming stations 321*a* to 321*d* and 322*a* to 322*d* are arranged at positions facing the housing units of the coloring materials 51*a* to 51*d* and 61*a* to 61*d*. In the MFP 1 illustrated in FIGS. 1 to 3, a fixing unit 35 and a sheet discharge trays T11 and T12 are further included. The fixing unit 35 is arranged at the rear stage of the first to eighth image forming stations 321*a* to 321*d* and 322*a* to 322*d*. The sheet discharge tray T11 that is a first sheet discharge destination and the sheet discharge tray T12 that is a second sheet discharge destination are disposed to protrude from the side face of the main body of the MFP 1.

In contrast to FIGS. 1 to 3, in the MFP 1 illustrated in FIGS. 6 and 7, the housing units of the coloring materials 51*a* to 51*d* are arranged in the moving direction (from the right side to the left side in the figure) of an intermediate transfer belt 33 to be described later. The housing units of the coloring materials 61*a* to 61*d* are arranged on the rear side (the rear-face side in the figure) of the housing units of the coloring materials 51*a* to 51*d*. Accordingly, in the MFP 1 illustrated in FIGS. 6 and 7, the housing units of the coloring materials 61*a* to 61*d* are in the state being hidden by the housing units of the coloring materials 51*a* to 51*d*. In addition, in the MFP 1 illustrated in FIGS. 6 and 7, the first to fourth image forming stations 321*a* to 321*d* are arranged at positions facing the housing units of the coloring materials 51*a* to 51*d*. Furthermore, in the MFP 1 illustrated in FIGS. 6 and 7, the fifth to eighth image forming stations 322*a* to 322*d* are arranged at positions facing the housing units of the coloring materials 61*a* to 61*d*. Accordingly, in the MFP 1 illustrated in FIGS. 6 and 7, the fifth to eighth image forming stations 322*a* to 322*d* are in the state being hidden by the first to fourth image forming stations 321*a* to 321*d*. In addition, in the MFP 1 illustrated in FIGS. 6 and 7, the sheet discharge trays T11 and T12 are disposed at positions enclosed by the main body of the MFP 1.

For example, the MFP 1 illustrated in FIGS. 6 and 7 includes a moving mechanism that moves the first to eighth image forming stations 321*a* to 321*d* and 322*a* to 322*d* to positions facing the intermediate transfer belt 33 and positions deviated from the positions facing the intermediate transfer belt 33. The moving mechanism moves the first image forming station (or the fifth image forming station) to be used out of the first image forming station 321*a* and the fifth image forming station 322*a* to a position facing the intermediate transfer belt 33. The moving mechanism moves the fifth image forming station (or the first image forming station) not to be used out of the first image forming station 321*a* and the fifth image forming station 322*a* to a position deviated from the position facing the intermediate transfer belt 33. The fifth image forming station (or the first image forming station) not to be used is in the standby state at the position deviated from the position facing the intermediate transfer belt 33.

Similarly, the moving mechanism moves the second image forming station (or the sixth image forming station), to be used out of the second image forming station 321*b* and the sixth image forming station 322*b* to a position facing the intermediate transfer belt 33. The moving mechanism moves the sixth image forming station (or the second image forming station) not to be used out of the second image forming station 321*b* and the sixth image forming station 322*b* to a position deviated from the position facing the intermediate transfer belt 33. The sixth image forming station (or the second image forming station) not to be used is in the standby state at the position deviated from the position facing the intermediate transfer belt 33.

Similarly, the moving mechanism moves the third image forming station (or the seventh image forming station), to be used out of the third image forming station 321*c* and the seventh image forming station 322*c* to a position facing the intermediate transfer belt 33. The moving mechanism moves the seventh image forming station (or the third image forming station) not to be used out of the third image forming station 321*c* and the seventh image forming station 322*c* to a position deviated from the position facing the intermediate transfer belt 33. The seventh image forming station (or the third image forming station) not to be used is in the standby state at the position deviated from the position facing the intermediate transfer belt 33.

Similarly, the moving mechanism moves the fourth image forming station (or the eighth image forming station) to be used out of the fourth image forming station 321*d* and the eighth image forming station 322*d* to the position facing the intermediate transfer belt 33. The moving mechanism moves the eighth image forming station (or the fourth image forming station) not to be used out of the fourth image forming station 321*d* and the eighth image forming station 322*d* to the position deviated from the position facing the intermediate transfer belt 33. The eighth image forming station (or the fourth image forming station) not to be used is in the standby state at the position deviated from the position facing the intermediate transfer belt 33.

By arranging the housing units of the coloring materials and the image forming stations as illustrated in FIGS. 6 and 7 in the MFP 1, the size of the MFP 1 in the widthwise direction (the horizontal direction in the figure) can be reduced. On the other hand, by arranging the housing units of the coloring materials and the image forming stations as illustrated in FIGS. 1 to 3 in the MFP 1, the size of the MFP 1 in the lengthwise direction (the forward and rearward direction in the figure) can be reduced.

The first to fourth image forming stations 321*a* to 321*d* of the MFP 1 respectively form single-color images of black (BK), cyan (C), magenta (M), and yellow (Y). In addition, the fifth to eighth image forming stations 322*a* to 322*d* of the MFP 1 respectively form single-color images of BK, C, M, and Y. The MFP 1 includes a conveyance unit that conveys a recording medium, for example, a sheet on which an image is formed by the first to eighth image forming stations 321*a* to 321*d* and 322*a* to 322*d* to the sheet discharge trays T11 and T12 through the fixing unit 35.

The MFP 1, for example, forms an image by an electrophotographic system. The first to eighth image forming stations 321*a* to 321*d* and 322*a* to 322*d* use toner as the coloring materials and form toner images on a sheet. The MFP 1, as described above, includes the fixing unit 35 that is arranged at the rear stage of the first to eighth image forming stations 321*a* to 321*d* and 322*a* to 322*d*. The conveyance unit conveys the sheet on which the toner image is formed to the fixing unit 35. The fixing unit 35 fixes the toner image on the sheet by heating the toner image to a predetermined fixing temperature.

The system used by the MFP 1 for forming an image is not limited to the electrophotographic system. For example, in a case where the MFP 1 forms an image by an ink jet system, the first to eighth image forming stations 321*a* to 321*d* and 322*a* to 322*d* form an image on a sheet by using ink as the coloring materials.

In addition, the colors of single-color images formed by the first to eighth image forming stations 321*a* to 321*d* and 322*a* to 322*d* are arbitrary and may be combined in various types depending on properties of toners and colors of inks to be used.

The single-color images of the four colors BK, C, M, and Y formed by the image forming stations 321*a* to 321*d* are formed by using toner, which is a coloring material discolorable in a predetermined condition, or discolorable ink. A coloring material 51*a* is discolorable toner or discolorable ink of the color BK. A coloring material 51*b* is discolorable toner or discolorable ink of the color C. A coloring material 51*c* is discolorable toner or discolorable ink of the color M. A coloring material 51*d* is discolorable toner or discolorable ink of the color Y.

The single-color images of the four colors BK, C, M, and Y formed by the image forming stations 322*a* to 322*d* are formed by using toner, which is a coloring material non-discolorable in a predetermined condition, or non-discolorable ink. The coloring material 61*a* is non-discolorable toner or non-discolorable ink of a color (for example, a similar color of BK) corresponding to the coloring material 51*a*. The coloring material 61*b* is non-discolorable toner or non-discolorable ink of a color (for example, a similar color of C) corresponding to the coloring material 51*b*. The coloring material 61*c* is non-discolorable toner or non-discolorable ink of a color (for example, a similar color of M) corresponding to the coloring material 51*c*. The coloring material 61*d* is non-discolorable toner or non-discolorable ink of a color (for example, a similar color of Y) corresponding to the coloring material 51*d*.

An example of the above-described condition is heat (temperature). The discolorable toner has the color being lost or changed by being heated to a predetermined temperature that is higher than the heating temperature (fixing temperature) of the fixing unit 35 at the time of a fixing process. For example, toner that is a discolorable coloring material has the color changed to a color different from the original color by being heated to a predetermined temperature (discoloring temperature) higher than the fixing temperature. For example, the different color is a transparent color. Accordingly, the fixing unit 35 can discolor the image by heating the image, which is formed by using discolorable toner, to a discoloration temperature. In addition, the color of the discolorable toner changes from the original color to a transparent color having a substantial 100% transparency by being heated to a predetermined temperature (erasing temperature) that is higher than the discoloration temperature. In other words, the discolorable toner loses the color by being heated to the erasing temperature. Hereinafter, the losing of the color will be referred to as decoloration. Accordingly, the fixing unit 35 can erase the image by heating the image formed by using discolorable toner to the erasing temperature. The discolorable ink is decolored or discolored also at a heating temperature that is lower than the discoloring temperature based on the composition of dyes contained in the ink or the like. Another example of the predetermined condition is light (an ultraviolet ray or the like). The discolorable ink is decolored or discolored based on the composition of dyes contained in the ink in accordance with the irradiation of ultraviolet ray thereto or the like.

A specific example of the discolorable toners 51*a* to 51*d* used by the MFP 1 and the principles of the discoloration and the decoloration of the discolorable toners 51*a* to 51*d* will be further described.

The discolorable toners 51*a* to 51*d* used by the MFP 1 start to be discolored when being heated to the discoloring temperature. When the discolorable toners 51*a* to 51*d* are heated further to the erasing temperature, the color thereof becomes a transparent color having 100% transparency, whereby the discolorable toners are decolored. More specifically, each one of the discolorable toners 51*a* to 51*d* contains a binder resin and a pigment. The binder resin is the same as well-known toner (non-discolorable toner). A discolorable toner 50 has a feature in the pigment. The pigment contains a coloring compound, a developing agent, and a discoloring temperature regulating agent (temperature control agent). The coloring compound is a color former and, for example, a leuco dye is used. As the developing agent, for example, a phenolic compound is used. When being heated, the discoloring temperature regulating agent is compatible with the coloring compound, and a material not having affinity to the developing agent is used as the discoloring temperature regulating agent. The discolorable toner represents a predetermined color as the coloring compound develops a color by interacting with the developing agent. The discolorable toner weakens the interaction between the coloring compound and the developing agent by being heated to the discoloring temperature or higher, thereby starting to be discolored into the transparent color. The discolorable toner is decolored by disconnecting the interaction between the coloring compound and the developing agent by being further heated to the erasing temperature or higher. The discoloring temperature and the erasing temperature can be adjusted by appropriately combining the discoloring temperature regulating agent therewith.

Hereinafter, a specific configuration of the MFP 1 will be described with reference to FIGS. 6 to 8. The MFP 1 forms an image by using toner as the coloring materials 51*a* to 51*d* and 61*a* to 61*d* by the electrophotographic system.

The MFP 1, as illustrated in FIGS. 7 and 8, at least includes an image forming unit 3, an image reading unit 5, an operation panel 9, and a control unit 7. The control unit 7, as will be described later, performs signal processing and operation control. The control unit 7 is configured by a circuit board. The operation panel 9, as will be described later, includes a display unit 9*a*. The operation panel 9 is arranged at a predetermined position of the MFP 1.

Figure 9:
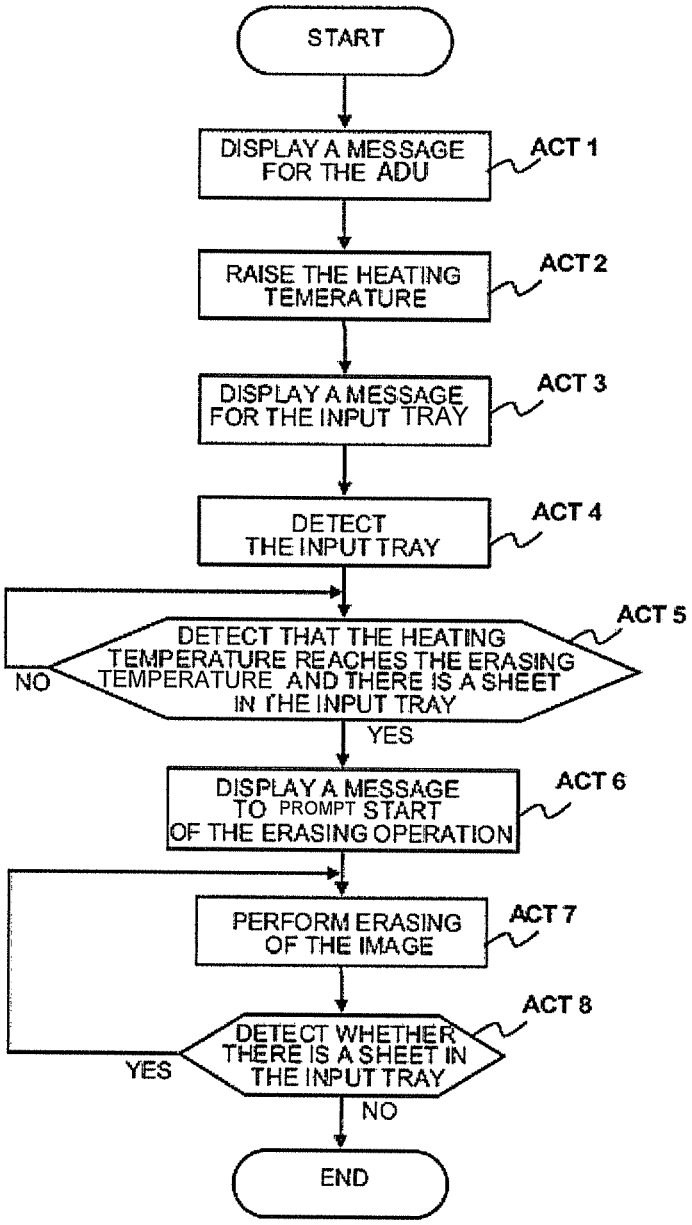
FIG. 9 is a flowchart illustrating an image erasing operation of the image forming apparatus according to the first embodiment.

The image forming unit 3 forms a visible image (toner image) corresponding to image data on a sheet formed of paper or resin. The image data, for example, may be data generated by the image reading unit 5 or data that is externally acquired. The image data that is externally acquired may be data that is supplied from a portable storage medium such as a semiconductor memory to the MFP 1 or data that is supplied from a supply source such as a personal computer (PC) on a network to the MFP 1 through an I/F (Interface) 71 as shown in FIG. 9.

The image reading unit 5 acquires texts and images of a document that is a reading target as shadings of light and generates image data that corresponds to the shadings.

The image reading unit 5 at least includes a document table 5*a*, a lighting device, and an image sensor. The document table 5*a* supports the document that is the reading target. The document table 5*a* is configured by a transparent member, for example, glass. The lighting device outputs light toward the document that is supported by the document table 5*a*. The image sensor converts reflected light (image information) that is reflected from the document into an image signal. The image sensor, for example, is a charge coupled device (CCD) sensor or a complementary metal-oxide semiconductor (CMOS) sensor.

The control unit 7 converts the image signal into image data that is appropriate to image formation performed by the image forming unit 3 by processing the image signal generated by the image reading unit 5. More specifically, in order to form an image, the control unit 7 performs predetermined processes such as identification of characters, a contour correction, a color tone correction (color conversion, RGB→CMY, density), a half tone (gray scale) process, and a γ characteristic (input density value vs. output density) process for an image signal supplied from the image sensor. The image signal and the image data are stored in a storage device (not illustrated), for example, a hard disk drive (HDD), a semiconductor memory that can be read from the MFP 1, or the like.

The image forming unit 3 includes an exposure unit 31, the first to eighth image forming stations 321*a* to 321*d* and 322*a* to 322*d*, a primary transfer unit described later, the intermediate transfer belt 33, a secondary transfer unit 34, the fixing unit 35; a waste toner collecting mechanism 36, an intermediate transfer belt cleaner 37, a waste toner recovery device 38, and the like. The fixing unit 35 serves also as a unit that erases an image and discolors an image.

The image forming unit 3 includes a sheet feeding unit, an aligning mechanism 45, and an ADU (Automatically Duplex Unit) 40. The sheet feeding unit includes at least one sheet cassette 41, a manual feeding tray 46, and a second manual feeding tray 146. The sheet cassette 41 houses sheets for image formation. The sheet cassette 41 is mounted to be detachably attached to a cassette mounting unit that is disposed on the lower side of the main body of the MFP 1. The image forming unit 3 includes a sheet feeding mechanism 42, a separation mechanism 43, and a conveyance mechanism 44 as conveyance units disposed for each cassette 41.

The manual feeding tray 46 holds sheets for image formation. The manual feeding tray 46 is mounted to be detachably attached to a first tray mounting unit that is disposed on the lower side of the side face of the main body of the MFP 1. More specifically, the first tray mounting unit includes a supporting point 46*a*. The manual feeding tray 46 is mounted to be detachably attached to this supporting point 46*a*. The manual feeding tray 46 mounted at the supporting point 46*a* can be open or closed with respect to the side face of the main body of the MFP 1 by being supported to be rotatable around the supporting point 46*a* as the center in a direction denoted by arrow A. In the closed state, the manual feeding tray 46 substantially adheres to the side face of the main body of the MFP 1. In the open state, the manual feeding tray 46 is separated from the side face of the main body of the MFP 1 and can hold sheets. Accordingly, in a case where the manual feeding tray 46 is used, a user can open the manual feeding tray 46 with respect to the side face of the main body of the MFP 1. When the manual feeding tray 46 is not used, the user can close the manual feeding tray 46 with respect to the side face of the main body of the MFP 1.

The image forming unit 3 includes a sheet feeding mechanism 47, a separation mechanism 48, and a timing matching mechanism 49 as conveyance units for the manual feeding tray 46. The supporting point 46*a* of the first tray mounting unit, the sheet feeding mechanism 47, the separation mechanism 48, and the timing matching mechanism 49 are arranged on the front stage of the aligning mechanism 45.

The sheet feeding mechanism 47 extracts sheets from the manual feeding tray 46. The separation mechanism 48 separates the sheets extracted from the manual feeding tray 46 one by one. The timing matching mechanism 49 conveys the sheets separated one by one to the aligning mechanism 45 in accordance with the operation of the image forming unit 3.

The second manual feeding tray 146 holds a sheet for erasing an image formed on the sheet and discoloring the image. The second manual feeding tray 146 is mounted to be detachably attached to a second tray mounting unit that is disposed on the upper side of the side face of the main body of the MFP 1. More specifically, the second tray mounting unit includes a supporting point 146*a*. The second manual feeding tray 146 is mounted to be detachably attached to this supporting point 146*a*. The second manual feeding tray 146 mounted at the supporting point 146*a* can be open or closed with respect to the side face of the main body of the MFP 1 by being supported to be rotatable around the supporting point 146*a* as the center in a direction denoted by arrow A. In the closed state, the second manual feeding tray 146 substantially adheres to the side face of the main body of the MFP 1. In the open state, the second manual feeding tray 146 is separated from the side face of the main body of the MFP 1 and can hold sheets. Accordingly, in a case where the second manual feeding tray 146 is used, the user can open the second manual feeding tray 146 with respect to the side face of the main body of the MFP 1. When the second manual feeding tray 146 is not used, the user can close the second manual feeding tray 146 with respect to the side face of the main body of the MFP 1.

The image forming unit 3 includes a sheet feeding mechanism 147, a separation mechanism 148, and a timing matching mechanism 149 as conveyance units for the second manual feeding tray 146. The supporting point 146*a* of the second tray mounting unit, the sheet feeding mechanism 147, the separation mechanism 148, and the timing matching mechanism 149 are arranged on the rear stage of the aligning mechanism 45 and between a transfer position and the fixing unit 35. The transfer position is a position at which the intermediate transfer belt 33 and the secondary transfer unit 34 are brought into contact with each other.

The sheet feeding mechanism 147 extracts sheets from the second manual feeding tray 146. The separation mechanism 148 separates the sheets extracted from the second manual feeding tray 146 one by one. The timing matching mechanism 149 conveys the sheets separated one by one to the fixing unit 35 in accordance with the operation of the fixing unit 35.

The exposure unit 31 converts the image data output by the image processing unit 73 of the control unit 7 into intensities of laser light. The exposure unit 31 irradiates laser light converted from the image data of respective colors BK, C, M, and Y to photosensitive drums of the first to fourth image forming stations 321*a* to 321*d* or the fifth to eighth image forming stations 322*a* to 322*d*. Alternatively, the exposure unit 31 irradiates the laser light converted from the image data to the photosensitive drum of the first image forming station 321*a* or the fifth image forming station 322*a*, the photosensitive drum of the second image forming station 321*b* or the sixth image forming station 322*b*, the photosensitive drum of the third image forming station 321*c* or the seventh image forming station 322*c*, and the photosensitive drum of the fourth image forming station 321*d* or the eighth image forming station 322*d*.

The exposure unit 31 forms latent images on photosensitive drums of the first to eighth image forming stations 321*a* to 321*d* and 322*a* to 322*d* by irradiating laser light thereto.

For example, in a case where the MFP 1 forms a full-color image by using the discolorable toners 51*a* to 51*d* (in the case of the full-color printing of the first image forming mode to be described later), the exposure unit 31 forms respective latent images on the photosensitive drums of the first to fourth image forming stations 321*a* to 321*d* by irradiating laser light thereto. The image forming stations 321*a* to 321*d* develop the latent images by using the discolorable toners 51*a* to 51*d* of the respective colors BK, C, M, and Y, thereby forming images of the respective discolorable toners 51*a* to 51*d* of the colors BK, C, M, and Y on the photosensitive drums as visualized images.

Each one of the first to fourth image forming stations 321*a* to 321*d* includes the photosensitive drum that is an image carrier, a developing unit, and a primary transfer unit. The photosensitive drum of the image forming station 321*a* is used for the formation of an image of the color BK. The photosensitive drum of the image forming station 321*a* generates an electrostatic latent image that corresponds to laser light, which is irradiated from the exposure unit 31, used for the formation of the image of the color BK. The developing unit of the image forming station 321*a* develops the electrostatic latent image by supplying the discolorable toner 51*a* of the color BK to the photosensitive drum for the formation of an image of the color BK. The developing unit of the image forming station 321*a* develops the electrostatic latent image, thereby forming an image of the discolorable toner 51*a* of the color BK on the photosensitive drum for the formation of an image of the color BK. The primary transfer unit of the image forming station 321*a* transfers the image of the discolorable toner 51*a* of the color BK formed on the photosensitive drum for the formation of an image of the color BK to the intermediate transfer belt 33.

The photosensitive drum of the image forming station 321*b* is used for the formation of an image of the color C. The photosensitive drum of the image forming station 321*b* generates an electrostatic latent image that corresponds to laser light, which is irradiated from the exposure unit 31, used for the formation of the image of the color C. The developing unit of the image forming station 321*b* develops the electrostatic latent image by supplying the discolorable toner 51*b* of the color C to the photosensitive drum for the formation of an image of the color C. The developing unit of the image forming station 321*b* develops the electrostatic latent image, thereby forming an image of the discolorable toner 51*b* of the color C on the photosensitive drum for the formation of an image of the color C. The primary transfer unit of the image forming station 321*b* transfers the image of the discolorable toner 51*b* of the color C formed on the photosensitive drum for the formation of an image of the color C to the intermediate transfer belt 33.

The photosensitive drum of the image forming station 321*c* is used for the formation of an image of the color M. The photosensitive drum of the image forming station 321*c* generates an electrostatic latent image that corresponds to laser light, which is irradiated from the exposure unit 31, used for the formation of the image of the color M. The developing unit of the image forming station 321*c* develops the electrostatic latent image by supplying the discolorable toner 51*c* of the color M to the photosensitive drum for the formation of an image of the color M. The developing unit of the image forming station 321*c* develops the electrostatic latent image, thereby forming an image of the discolorable toner 51*c* of the color M on the photosensitive drum for the formation of an image of the color M. The primary transfer unit of the image forming station 321*c* transfers the image of the discolorable toner 51*c* of the color M formed on the photosensitive drum for the formation of an image of the color M to the intermediate transfer belt 33.

The photosensitive drum of the image forming station 321*d* is used for the formation of an image of the color Y. The photosensitive drum of the image forming station 321*d* generates an electrostatic latent image that corresponds to laser light, which is irradiated from the exposure unit 31, used for the formation of the image of the color Y. The developing unit of the image forming station 321*d* develops the electrostatic latent image by supplying the discolorable toner 51*d* of the color Y to the photosensitive drum for the formation of an image of the color Y. The developing unit of the image forming station 321*d* develops the electrostatic latent image, thereby forming an image of the discolorable toner 51*d* of the color Y on the photosensitive drum for the formation of an image of the color Y. The primary transfer unit of the image forming station 321*d* transfers the image of the discolorable toner 51*d* of the color Y formed on the photosensitive drum for the formation of an image of the color Y to the intermediate transfer belt 33.

In a case where a full-color image is formed, the four-color images of the discolorable toners 51*a* to 51*d* overlap each other to be transferred to the intermediate transfer belt 33. The arrangement positions of the image forming stations 321*a* to 321*d*, in other words, the order in which the images of the discolorable toners 51*a* to 51*d* are formed on the intermediate transfer belt 33 is determined in accordance with the image forming process and the characteristics of the toner.

The intermediate transfer belt 33 maintains the images of discolorable toners formed by the first to fourth image forming stations 321*a* to 321*d* and conveys the maintained images to the transfer position.

For example, in a case where the MFP 1 forms a full-color image by using the non-discolorable toners 61*a* to 61*d* (in the case of the full-color printing of the second image forming mode to be described later), the exposure unit 31 forms electrostatic latent images on the respective photosensitive drums of the respective image forming stations 322*a* to 322*d* by irradiating the laser light thereto. The image forming stations 322*a* to 322*d* develop the electrostatic latent images by using the non-discolorable toners 61*a* to 61*d* of the colors BK, C, M, and Y, thereby forming images of non-discolorable toners 61*a* to 61*d* of the colors BK, C, M, and Y as visualized images.

Each one of the fifth to eighth image forming stations 322*a* to 322*d*, similar to the first to fourth image forming stations 321*a* to 321*d*, includes the photosensitive drum that is an image carrier, a developing unit, and a primary transfer unit.

The photosensitive drum of the image forming station 322*a* is used for the formation of an image of the color BK. The photosensitive drum of the image forming station 322*a* generates an electrostatic latent image that corresponds to laser light, which is irradiated from the exposure unit 31, used for the formation of the image of the color BK. The developing unit of the image forming station 322*a* develops the electrostatic latent image by supplying the non-discolorable toner 61*a* of the color BK to the photosensitive drum for the formation of an image of the color BK. The developing unit of the image forming station 322*a* develops the electrostatic latent image, thereby forming an image of the non-discolorable toner 61*a* of the color BK on the photosensitive drum for the formation of an image of the color BK. The primary transfer unit of the image forming station 322*a* transfers the image of the non-discolorable toner 61*a* formed on the photosensitive drum for the formation of an image of the color BK to the intermediate transfer belt 33.

The photosensitive drum of the image forming station 322*b* is used for the formation of an image of the color C. The photosensitive drum of the image forming station 322*b* generates an electrostatic latent image that corresponds to laser light, which is irradiated from the exposure unit 31, used for the formation of the image of the color C. The developing unit of the image forming station 322*b* develops the electrostatic latent image by supplying the non-discolorable toner 61*b* to the photosensitive drum for the formation of an image of the color C. The developing unit of the image forming station 322*b* develops the electrostatic latent image, thereby forming an image of the non-discolorable toner 61*b* of the color C on the photosensitive drum for the formation of an image of the color C. The primary transfer unit of the image forming station 322*b* transfers the image of the non-discolorable toner 61*b* formed on the photosensitive drum for the formation of an image of the color C to the intermediate transfer belt 33.

The photosensitive drum of the image forming station 322*c* is used for the formation of an image of the color M. The photosensitive drum of the image forming station 322*c* generates an electrostatic latent image that corresponds to laser light, which is irradiated from the exposure unit 31, used for the formation of the image of the color M. The developing unit of the image forming station 322*c* develops the electrostatic latent image by supplying non-discolorable toner 61*c* of the color M to the photosensitive drum for the formation of an image of the color M. The developing unit of the image forming station 322*c* develops the electrostatic latent image, thereby forming an image of the non-discolorable toner 61*c* of the color M on the photosensitive drum for the formation of an image of the color M. The primary transfer unit of the image forming station 322*c* transfers the image of the non-discolorable toner 61*c* formed on the photosensitive drum for the formation of an image of the color M to the intermediate transfer belt 33.

The photosensitive drum of the image forming station 322*d* is used for the formation of an image of the color Y. The photosensitive drum of the image forming station 322*d* generates an electrostatic latent image that corresponds to laser light, which is irradiated from the exposure unit 31, used for the formation of the image of the color Y. The developing unit of the image forming station 322*d* develops the electrostatic latent image by supplying non-discolorable toner 61*d* to the photosensitive drum for the formation of an image of the color Y. The developing unit of the image forming station 322*d* develops the electrostatic latent image, thereby forming an image of the non-discolorable toner 61*d* on the photosensitive drum for the formation of an image of the color Y. The primary transfer unit of the image forming station 322*d* transfers the image of the non-discolorable toner 61*d* formed on the photosensitive drum for the formation of an image of the color Y to the intermediate transfer belt 33. In a case where a full-color image is formed, the images of the non-discolorable toners 61*a* to 61*d* of the above-described four colors overlap each other to be transferred to the intermediate transfer belt 33.

The arrangement positions of the fifth to eighth image forming stations 322*a* to 322*d*, in other words, the order in which the images of the non-discolorable toners 61*a* to 61*d* are formed on the intermediate transfer belt 33 is determined in accordance with the image forming process and the characteristics of the toner.

The intermediate transfer belt 33 maintains the images of non-discolorable toners formed by the fifth to eighth image forming stations 322*a* to 322*d* and conveys the maintained images to the transfer position.

For example, in a case where the MFP 1 forms a full-color image by using a combination of any one of the discolorable coloring materials 51*a* to 51*d* and any one of the non-discolorable toners 61*a* to 61*d* (in the case of the full-color printing of the third image forming mode to be described later), the exposure unit 31 forms electrostatic latent images on the photosensitive drum of the first image forming station 321*a* or the fifth image forming station 322*a*, the photosensitive drum of the second image forming station 321*b* or the sixth image forming station 322*b*, the photosensitive drum of the third image forming station 321*c* or the seventh image forming station 322*c*, and the photosensitive drum of the fourth image forming station 321*d* or the eighth image forming station 322*d* by irradiating the laser light thereto. The first or fifth image forming station 321*a* or 322*a*, the second or sixth image forming station 321*b* or 322*b*, the third or seventh image forming station 321*c* or 322*c*, and the fourth or eighth image forming station 321*d* or 322*d* respectively develop the electrostatic latent images by using the coloring material 51*a* or 61*a*, the coloring material 51*b* or 61*b*, the coloring material 51*c* or 61*c*, and the coloring material 51*d* or 61*d*, thereby forming images of toners of the colors BK, C, M, and Y on the photosensitive drums as visualized images.

The developing unit of the first image forming station 321*a* or the fifth image forming station 322*a* develops the electrostatic latent image by supplying the discolorable toner 51*a* or the non-discolorable toner 61*a* to the photosensitive drum for the formation of an image of the color BK. The developing unit of the first image forming station 321*a* or the fifth image forming station 322*a* forms an image of the discolorable toner 51*a* or the non-discolorable toner 61*a* on the photosensitive drum for the formation of an image of the color BK by developing the electrostatic latent image. The primary transfer unit of the first image forming station 321*a* or the fifth image forming station 322*a* transfers the image of the discolorable toner 51*a* or the non-discolorable toner 61*a* formed on the photosensitive drum for the formation of an image of the color BK to the intermediate transfer belt 33.

The developing unit of the second image forming station 321*b* or the sixth image forming station 322*b* develops the electrostatic latent image by supplying the discolorable toner 51*b* or the non-discolorable toner 61*b* to the photosensitive drum for the formation of an image of the color C. The developing unit of the second image forming station 321*b* or the sixth image forming station 322*b* forms an image of the discolorable toner 51*b* or the non-discolorable toner 61*b* on the photosensitive drum for the formation of an image of the color C by developing the electrostatic latent image. The primary transfer unit of the second image forming station 321*b* or the sixth image forming station 322*b* transfers the image of the discolorable toner 51*b* or the non-discolorable toner 61*b* formed on the photosensitive drum for the formation of an image of the color C to the intermediate transfer belt 33.

The developing unit of the third image forming station 321*c* or the seventh image forming station 322*c* develops the electrostatic latent image by supplying the discolorable toner 51*c* or the non-discolorable toner 61*c* to the photosensitive drum for the formation of an image of the color M. The developing unit of the third image forming station 321*c* or the seventh image forming station 322*c* forms an image of the discolorable toner 51*c* or the non-discolorable toner 61*c* on the photosensitive drum for the formation of an image of the color M by developing the electrostatic latent image. The primary transfer unit of the third image forming station 321*c* or the seventh image forming station 322*c* transfers the image of the discolorable toner 51*c* or the non-discolorable toner 61*c* formed on the photosensitive drum for the formation of an image of the color M to the intermediate transfer belt 33.

The developing unit of the fourth image forming station 321*d* or the eighth image forming station 322*d* develops the electrostatic latent image by supplying the discolorable toner 51*d* or the non-discolorable toner 61*d* to the photosensitive drum for the formation of an image of the color Y. The developing unit of the fourth image forming station 321*d* or the eighth image forming station 322*d* forms an image of the discolorable toner 51*d* or the non-discolorable toner 61*d* on the photosensitive drum for the formation of an image of the color Y by developing the electrostatic latent image. The primary transfer unit of the fourth image forming station 321*d* or the eighth image forming station 322*d* transfers the image of the discolorable toner 51*d* or the non-discolorable toner 61*d* formed on the photosensitive drum for the formation of an image of the color Y to the intermediate transfer belt 33.

In a case where a full-color image is formed by using the discolorable toner and the non-discolorable toner in combination, the images of the toners of four colors by combining the discolorable toner and the non-discolorable toner overlap each other to be transferred to the intermediate transfer belt 33.

The intermediate transfer belt 33 maintains the images of the discolorable toners and the non-discolorable toners formed by the first or fifth image forming station, the second or sixth image forming station, the third or seventh image forming station, and the fourth or eighth image forming station and conveys the maintained images to the transfer position.

The secondary transfer unit 34 transfers the images of the toners conveyed by the intermediate transfer belt 33 from the intermediate transfer belt 33 to a sheet at the transfer position.

The fixing unit 35 fixes the images of the toners transferred by the secondary transfer unit 34 from the intermediate transfer belt 33 to the sheet to the sheet.

The toner (residual toner after the primary transfer) remaining on the photosensitive drums of the first to eighth image forming stations 321*a* to 321*d* and 322*a* to 322*d* without being transferred from the photosensitive drums to the intermediate transfer belt 33 is removed by a cleaner (not illustrated). The waste toner collecting mechanism 36 collects the residual toner after the primary transfer, which is removed by the cleaner, such that the waste toner recovery device 38 to be described later can recover the residual toner after the primary transfer. The waste toner collecting mechanism 36 collects the residual toner after the primary transfer near the primary transfer units of the image forming stations 321*a* to 321*d* and 322*a* to 322*d*.

After the secondary transfer performed by the secondary transfer unit 34, toner that is not transferred to the sheet remains on the intermediate transfer belt 33 (residual toner after the secondary transfer). The intermediate transfer belt cleaner 37 removes and collects the residual toner after the secondary transfer from the intermediate transfer belt 33 such that the waste toner recovery device 38 to be described later can recover the residual toner after the secondary transfer. The intermediate transfer belt cleaner 37 collects the residual toner after the secondary transfer near the secondary transfer unit 34.

The waste toner recovery device 38 recovers the residual toner after the primary transfer collected by the waste toner collecting mechanism 36 and the residual toner after the secondary transfer collected by the intermediate transfer belt cleaner 37.

The sheet feeding mechanism 42 extracts sheets from the sheet cassette 41 in response to image forming operations of the first to eighth image forming stations 321*a* to 321*d* and 322*a* to 322*d*. The separation mechanism 43 separates the sheets extracted by the sheet feeding mechanism 42 one by one. The conveyance mechanism 44 conveys the sheets separated one by one by the separation mechanism 43 to the aligning mechanism 45. The aligning mechanism 45 conveys the sheets to the transfer position in accordance with the timing of the image forming operations of the first to eighth image forming stations 321*a* to 321*d* and 322*a* to 322*d*. Accordingly, the sheets that are extracted from the sheet cassette 41 by the sheet feeding mechanism 42 and are separated by the separation mechanism 43 one by one are moved to the transfer position through the conveyance mechanism 44 and the aligning mechanism 45.

In a case where the MFP 1 forms an image on a sheet, the fixing unit 35 heats the sheet and the images of the toners 51*a* to 51*b* and 61*a* to 61*d* that are electrostatically attached to the sheet to the fixing temperature and presses them, thereby fixing the images of the toners 51*a* to 51*b* and 61*a* to 61*d* to the sheet. More specifically, the toners 51*a* to 51*b* and 61*a* to 61*d* that are electrostatically transferred to the sheet by the secondary transfer unit 34 are heated to the fixing temperature by the fixing unit 35 so as to be melted. In the toners 51*a* to 51*b* and 61*a* to 61*d*, coloring compounds develop colors in accordance with the actions of the developing agents, whereby the toners represent predetermined colors. The melted toners 51*a* to 51*b* and 61*a* to 61*d* maintain the state of representing the predetermined colors and are fused to the sheet by being pressed by the fixing unit 35. As the toners 51*a* to 51*b* and 61*a* to 61*d* are fused to the sheet, the images of the toners are fixed to the sheet.

The MFP 1 includes a discharge unit and a discharge roller (not illustrated). The discharge unit is disposed in a space portion between the image reading unit 5 and the image forming unit 3. The discharge unit holds a sheet that is discharged to the outside of the MFP 1. The discharge roller is disposed on the rear stage of the fixing unit 35. The discharge roller discharges a sheet on which the images of the toners are fixed to the discharge unit in cooperation with the fixing unit 35. In a case where images are formed on both faces of a sheet, the discharge roller reversely rotates, thereby sending the sheet discharged halfway to the discharge unit to the ADU 40.

The ADU 40 conveys the sheet delivered by the discharge roller to the aligning mechanism 45 again. The sheet is conveyed to the aligning mechanism 45 in the state in which the front and rear sides are reversed such that an image of toner is transferred to a second face (for example, the rear face) that is the back face of a first face (for example, the front face) on which an image of toner is fixed.

The ADU 40, as illustrated in FIG. 7, can be open or closed with respect to the side face of the main body of the MFP 1 by being supported to be rotatable in the direction of the arrow A around a supporting point 40*a* as the center. In the closed state, the ADU 40, as illustrated in FIG. 6, substantially adheres to the side face of the main body of the MFP 1 so as to cover the supporting point 146*a* of the second tray mounting unit and the second manual feeding tray 146 mounted at the supporting point 146*a*. The ADU 40 can be used in the closed state. On the other hand, in the open state, as illustrated in FIG. 8, the ADU 40 is separated from the side face of the main body of the MFP 1 such that the supporting point 146*a* of the second tray mounting unit and the second manual feeding tray 146 mounted at the supporting point 146*a* are exposed. For example, when a jam of a sheet occurs in the MFP 1, in order to remove the sheet from the MFP 1, the user can open the ADU 40 with respect to the side face of the main body of the MFP 1.

In the state in which the ADU 40 is closed (when the ADU 40 is used), since the supporting point 146*a* of the second tray mounting unit is covered with the ADU 40, the user can neither mount the second tray 146 at the supporting point 146*a* nor separate the second tray 146 from the supporting point 146*a*. In addition, in the state in which the ADU 40 is closed, since the second manual feeding tray 146 mounted at the supporting point 146*a* is covered with the ADU 40, the user cannot open the second manual feeding tray 146. On the other hand, in the state in which the ADU 40 is open (when the ADU 40 is not used), since the supporting point 146*a* of the second tray mounting unit is exposed, the user can mount the second manual feeding tray 146 at the supporting point 146*a* or separate the second manual feeding tray 146 from the supporting point 146*a*. In addition, in the state in which the ADU 40 is open, since the second manual feeding tray 146 mounted at the supporting point 146*a* is exposed, the user can open the second manual feeding tray 146. In other words, the second manual feeding tray 146 cannot be used in the state in which the ADU 40 is closed and can be used in the state in which the ADU 40 is open.

The second manual feeding tray 146 does not need to be constantly mounted at the supporting point 146*a* of the second tray mounting unit. The user may mount the second manual feeding tray 146 at the supporting point 146*a* only when the image formed on a sheet is erased or the image is discolored. The second manual feeding tray 146 has the same structure as that of the manual feeding tray 46. Accordingly, as illustrated in FIG. 8, the user can separate the manual feeding tray 46 from the supporting point 46*a* in the direction of the arrow B and mount the separated manual feeding tray 46 at the supporting point 146*a* of the second tray mounting unit in the direction of the arrow C. By allowing the manual feeding tray 46 to be used as the second manual feeding tray 146, the cost of components of the MFP 1 can be reduced.

The MFP 1, as described above, includes housing units that house the discolorable toners 51*a* to 51*d* and the non-discolorable coloring materials 61*a* to 61*d*. The housing units supply the discolorable toners 51*a* to 51*d* and the non-discolorable toners 61*a* to 61*d* to the developing units of the first to eighth image forming stations 321*a* to 321*d* and 322*a* to 322*d*. The housing units have a configuration capable of refilling the discolorable toners 51*a* to 51*d* and the non-discolorable toners 61*a* to 61*d* in a case where the residual amounts of the discolorable toners 51*a* to 51*d* and the non-discolorable toners 61*a* to 61*d*, which are housed, are insufficient. For example, each housing unit is disposed to be detachably attached to the main body of the MFP 1 so as to be replaced with a new housing unit. Accordingly, the MFP 1 has a configuration in which the discolorable toners 51*a* to 51*d* and the non-discolorable toners 61*a* to 61*d* can be refilled by the user replacing the housing unit that houses the toner of which the residual amount is insufficient in a case where the residual amount of any one of the discolorable toners 51*a* to 51*d* and the non-discolorable toners 61*a* to 61*d* is insufficient. The insufficiency of the residual amounts of the discolorable toners 51*a* to 51*d* and the non-discolorable toners 61*a* to 61*d* is detected by a residual amount detection unit 30 to be described later.

The control configuration of the MFP 1 will be described with reference to FIG. 8. FIG. 8 is a block diagram illustrating the control configuration of the MFP 1 according to the first embodiment. As illustrated in FIG. 8, the control unit 7 includes the I/F 71 that is an image input unit, an image processing unit 73, and a modulation circuit 75 that is an exposure signal generating unit. The I/F 71 receives image data that is supplied from an external device such as a PC or image data that is supplied through a network or the like. The image processing unit 73 performs predetermined image processing relating to the identification of characters, the contour correction, the color tone correction, the γ characteristics, and the like described above for an image signal generated by the image reading unit 5 or the image data supplied from the I/F 71. The modulation circuit 75 converts the image data processed by the image processing unit 73 into a modulation signal (exposure signal) for the laser light beam by the exposure unit 31.

The control unit 7 includes a central processing unit (CPU) 77 and a main processing unit (MPU) 79. The CPU 77 controls the image signal system of the I/F 71, the image processing unit 73, the modulation circuit 75, and the like. The MPU 79 is connected to the CPU 77 and controls the overall operation of the MFP 1 including the image forming unit 3 and the image reading unit 5. For example, the MPU 79 controls the image reading operation of the image reading unit 5 and the image forming operation of the image forming unit 3. In addition, the MPU 79 controls the heating temperature of the fixing unit 35 at the time of performing the image forming operation and the heating temperature of the fixing unit 35 at the time of performing an image erasing operation and an image decoloring operation to be described later. The heating temperature of the fixing unit 35, as will be described later, is controlled by the MPU 79 so as to be changed from the fixing temperature to the erasing temperature at the time of the image erasing operation. The heating temperature of the fixing unit 35 is controlled by the MPU 79 so as to be changed from the fixing temperature to the discoloring temperature at the time of performing the image discoloring operation. The heating temperature of the fixing unit 35 is controlled by the MPU 79 so as to be changed from the erasing temperature or the discoloring temperature to the fixing temperature at the time of the image forming operation.

The MPU 79 controls each unit of the MFP 1 in accordance with a control input from the operation panel 9 that receives a user's instruction for the MFP 1. The operation panel 9 includes a plurality of keys and a display panel 9*a*.

The plurality of keys of the operation panel 9 include a start key that receives a user's start instruction for an operation such as an image forming operation, an image erasing operation, or an image discoloring operation. The display panel 9*a* displays the state of each unit of the MFP 1, for example, a standby time for changing the heating temperature of the fixing unit 35 at the time of performing the image erasing operation, the image discoloring operation, and the image forming operation and the like by using a user interface that is widely known as a character string, a pictogram/icon, and the like. The display panel 9*a* displays the reception of a control input from the user and the content of the received input. The display panel 9*a* displays various contents described above under the control of the MPU 79. The MPU 79 is connected to the I/F (Interface) 72 for inputting/outputting information from/to the operation panel 9.

The control unit 7 includes a ROM (Read Only Memory) 111 storing a program, a RAM (Random Access Memory) 113, a NVM (Non-volatile Memory) 115, a page memory 117 and I/O port (Input/Output Port) 119. The page memory 117 is a work memory that provides a work area for the image processing performed by the image processing unit 73. The MPU 79 is connected to the ROM 111, the RAM 113, and the I/O port 119. The I/O port 119 inputs the output of a sensor 120 to the MPU 79. The sensor 120 includes an ADU sensor that detects the opening/closing of the ADU 40 and a tray sensor that detects a usable state of any one of the manual feeding tray 46 and the second manual feeding tray 146. The usable state of any one of the manual feeding tray 46 and the second manual feeding tray 146 is a state indicating whether the manual feeding tray 46 or the second manual feeding tray 146 is attached to either the supporting point 46*a* or the supporting point 146*a*.

In addition, the sensor 120, for example, includes a temperature sensor that detects the heating temperature of the fixing unit 35, a sheet sensor that detects the presence/absence of a sheet in the manual feeding trays 46 and 146, a discharge sensor that detects the passage of a sheet through the fixing unit 35, and the like.

The MPU 79 is connected to a motor driver 121 that controls the rotation of arbitrary motors 131, 133, 139, and the like. The motor 131, for example, drives the image forming stations 32*a* to 32*d*, the intermediate transfer belt 33, and the like.

The motor 133 drives sheet conveying units from the cassette to the fixing unit 35 and the ADU 40, for example, the sheet feeding mechanism 42, the separation mechanism 43, the conveyance mechanism 44, the aligning mechanism 45, and the secondary transfer unit 34.

In addition, the motor 133 drives sheet conveying units from the manual feeding tray 46 to the fixing unit 35, for example, the sheet feeding mechanism 47, the separation mechanism 48, and the timing matching mechanism 49.

Furthermore, the motor 133 drives sheet conveying units from the second manual feeding tray 146 to the fixing unit 35, for example, the sheet feeding mechanism 147, the separation mechanism 148, the second timing matching mechanism 149, and the like.

The motor 139 drives the fixing unit 35 independently from the conveyance units 42 to 45, 47 to 49, and 147 to 149.

The motor 133 drives either the conveyance units 47 to 49 or the conveyance units 147 to 149 and stops the driving of the other conveyance units in accordance with the output (detection result) of the tray sensor of the sensor 20. The conveyance units 47 to 49 and the conveyance units 147 to 149 may be driven by motors that are independent from each other.

The MPU 79 is connected to a heater driving device 123 that drives a heater 35*a* for changing the heating temperature of the fixing unit 35. As will be described later, by changing the heating temperature using the heater 35*a*, the fixing unit 35 operates for fixing an image formed on a sheet, erasing the image, and discoloring the image.

The image erasing operation performed by the fixing unit 35 will be described with reference to FIG. 9. FIG. 9 is a flowchart illustrating the image erasing operation of the MFP 1.

The discolorable toner used for the image (toner image) of a sheet, as described above, is decolored by being heated to the erasing temperature. More specifically, the discolorable toner is decolored as the action of the developing agent for the coloring compound is stopped so as to resolve the color developed state. As the discolorable toner is decolored, the image of the sheet is erased. The discolorable toner used for the image of the sheet is discolored from the original color, for example, to a transparent color by being heated to the discoloring temperature. As the discolorable toner is discolored, the image of the sheet is discolored.

The fixing unit 35 includes a roller in which the heater 35*a* is built. The heater 35*a*, for example, is a heater lamp. The fixing unit 35 may be configured to include an induction heating coil (IH) heater, which causes induced heat on the metal face of the roller, as the heater 35*a*. The fixing unit 35 may be configured to include a belt instead of the roller and the IH heater, which causes induced heat on the metal layer of the belt, as the heater 35*a*. The fixing unit 35 heats the image of a sheet using the heater 35*a*. The fixing unit 35 can change the heating temperature according to the heater 35*a* to the fixing temperature, the discoloring temperature that is higher than the fixing temperature, and the erasing temperature.

In a case where the heating temperature of the fixing unit 35 is the fixing temperature, as described above, the fixing unit 35 fixes the image of the sheet. On the other hand, in a case where the heating temperature of the fixing unit 35 is the erasing temperature, the fixing unit 35 decolors the toner by heating the image of the sheet to the erasing temperature, thereby erasing the image of the sheet. In a case where the heating temperature of the fixing unit 35 is the discoloring temperature, the fixing unit 35 discolors the toner, for example, to have a transparent color by heating the image of the sheet to the discoloring temperature, thereby discoloring the image of the sheet. The MFP 1 can erase the image of the sheet and discolor the image by the fixing unit 35 without arranging independent units for erasing the image and discoloring the image.

The image erasing operation of the MFP 1 will be described with reference to FIG. 9. FIG. 9 is a flowchart illustrating the image erasing operation of the MFP 1. In a case where the MFP 1 performs the operation of erasing the image of a sheet, as illustrated in FIG. 9, in ACT 1, the operation panel 9 receives selection of the image erasing operation from the user, and the control unit 7 displays a message such as "Please open ADU" on the display panel 9*a* based on the user's selection of the image erasing operation from the operation panel 9.

In ACT 2, the control unit 7 instructs the heater driving device 123 to control the heater 35*a*. In order to raise the heating temperature of the fixing unit 35 to the erasing temperature, the heater driving device 123 starts temperature control of the heater 35*a* in accordance with the instruction from the control unit 7.

In ACT 3, the control unit 7 determines whether or not the ADU 40 is open based on the detection result by the ADU sensor that is input to the control unit 7 through the I/O port 119. As illustrated in FIG. 8, when the control unit 7 determines that the ADU 40 is open, the control unit 7 displays a message such as "Please mount manual feeding tray inside ADU" for urging the user to prepare the image erasing operation on the display panel 9*a*.

In ACT 4, the control unit 7 determines whether the manual feeding tray 46 or the second manual feeding tray 146 is mounted at the supporting point 146*a* based on of the detection result by the tray sensor that is input through the I/O port 119. Hereinafter, the manual feeding tray 46 is assumed to be mounted at the supporting point 146*a* in the description. As illustrated in FIG. 8, when the control unit 7 determines that the manual feeding tray 46 is mounted at the rotation supporting point 146*a*, the operation of the MFP 1 proceeds to ACT 5.

In ACT 5, the control unit 7 determines whether or not the heating temperature of the fixing unit 35 reaches the erasing temperature based on the detection result by the temperature sensor that is input through the I/O port 119.

In addition, in ACT 5 described above, the control unit 7 determines whether or not a sheet is present in the manual feeding tray 46 mounted at the supporting point 146*a* based on the detection result by the sheet sensor that is input through the I/O port 119. When it is determined that a sheet is not present in the manual feeding tray 46, the control unit 7 displays a message such as "Please place sheet in manual feeding tray" for urging the user to prepare the image erasing operation on the display panel 9*a*.

When the control unit 7 determines that the heating temperature of the fixing unit 35 reaches the erasing temperature, and a sheet is present in the manual feeding tray 46 (Yes in ACT 5), the operation of the MFP 1 proceeds to ACT 6.

In ACT 6, the control unit 7 displays a message such as "Please turn on start key" urging the user to start the image erasing operation on the display panel 9*a*. In ACT 6 described above, when the control unit 7 determines that the operation panel 9 receives the turning on of the start key, the operation of the MFP 1 proceeds to ACT 7.

In ACT 7, the control unit 7 instructs the motor driver 121 to control the driving of the motors 133 and 139. The motor driver 121 controls the motor 133 so as to drive the conveyance units 147 to 149. The motor 133 drives the conveyance units 147 to 149. The conveyance units 147 to 149 convey a sheet from the manual feeding tray 46 mounted at the supporting point 146*a* to the fixing unit 35. The motor driver 121 controls the motor 139 so as to drive the fixing unit 35. The motor 139 drives the fixing unit 35. The fixing unit 35 erases the image of the sheet while conveying the sheet.

In ACT 7 described above, the control unit 7 determines whether or not the sheet has passed through the fixing unit 35, in other words, whether or not erasing of the image of one sheet is completed based on the detection result by the discharge sensor that is input through the I/O port 119. When the control unit 7 determines that the erasing of the image of one sheet is completed, the operation of the MFP 1 proceeds to ACT 8.

In ACT 8, the control unit 7 determines whether or not a sheet is present in the manual feeding tray 46 mounted at the supporting point 146*a* based on the detection result by the sheet sensor that is input through the I/O port 119. In a case where the control unit 7 determines that a sheet is present in the manual feeding tray 46 (Yes in ACT 8), the operation of the MFP 1 is returned to ACT 7. On the other hand, in a case where the control unit 7 determines that a sheet is not present in the manual feeding tray 46 (No in ACT 8), the image erasing operation of the MFP 1 ends, and the MFP 1 is in the standby state.

During the image erasing operation performed in ACT 7, the ADU 40 is in the open state, and the motor driver 121 controls the motors 133 and 139 such that only the fixing unit 35 and the conveyance units 147 to 149 are driven. Accordingly, the power consumed by the motor 131 and the like driving the image forming stations 32*a* to 32*d* is not necessary, whereby the power consumption of the MFP 1 can be reduced.

In a case where the MFP 1 performs the operation of discoloring the image of the sheet, in the operation control illustrated in FIG. 9, the control unit 7 controls the heating temperature of the fixing unit 35 to be the discoloring temperature instead of the erasing temperature.

Figure 10:
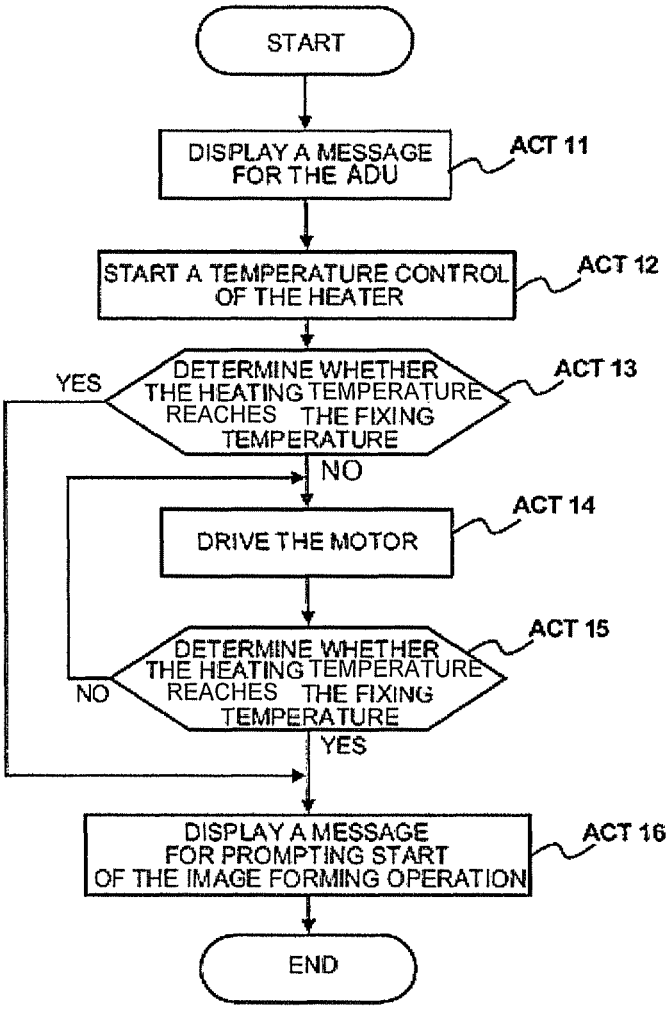
FIG. 10 is a flowchart illustrating the process of returning from an image erasing operation to an image forming operation in the image forming apparatus according to the first embodiment.

The operation of the MFP 1 for returning from the image erasing operation to the image forming operation will be described with reference to FIG. 10. FIG. 10 is a flowchart illustrating the operation of returning from the image erasing operation to the image forming operation in the MFP 1.

In the image erasing operation illustrated in FIG. 9, in order to erase the image of a sheet, the heating temperature of the fixing unit 35 is changed to the erasing temperature that is higher than the fixing temperature. Accordingly, in a case where the image forming operation is directed by the user, temperature control is necessary for lowering the heating temperature of the fixing unit 35 from the erasing temperature to the fixing temperature.

As illustrated in FIG. 10, in ACT 11, when the operation panel 9 receives termination of the image erasing operation, such as the user's selection of the image forming operation, the control unit 7 displays a message such as "Please separate manual feeding tray from ADU and close ADU" on the display panel 9*a* of the operation panel 9 based on the user's selection of the image forming operation from the operation panel 9.

In ACT 12, the control unit 7 instructs the heater driving device 123 to control the heater 35*a*. The heater driving device 123 starts control of the temperature of the heater 35*a* so as to lower the heating temperature of the fixing unit 35 to the fixing temperature in accordance with an instruction from the control unit 7.

In ACT 13, the control unit 7 determines whether or not the heating temperature of the fixing unit 35 reaches the fixing temperature based on the detection result by the temperature sensor that is input through the I/O port 119.

More specifically, for example, the control unit 7 predicts whether or not a time required for the heating temperature of the fixing unit 35 to reach the fixing temperature is longer than a predetermined time.

In ACT 13 described above, in a case where the control unit 7 predicts that the time required for the heating temperature of the fixing unit 35 to reach the fixing temperature is longer than the predetermined time (No in ACT 13 described above), the operation of the MFP 1 proceeds to ACT 14.

In ACT 14, the control unit 7 instructs the motor driver 121 to control driving of the motor 139. The motor driver 121 controls only the motor 139. The motor 139 drives the fixing unit 35 by operating for a predetermined time. By driving the fixing unit 35, a decrease in the heating temperature of the fixing unit 35 is promoted.

The case where the control unit 7 predicts that the time required for the heating temperature of the fixing unit 35 to reach the fixing temperature is longer than the predetermined time is a case where the heating temperature of the fixing unit 35 is higher than the fixing temperature, and, for example, a difference between the heating temperature and the fixing temperature is 10% of the fixing temperature or more.

In ACT 15, after the driving of the fixing unit 35 for the predetermined time, the control unit 7 determines 35 whether or not the heating temperature of the fixing unit has reached the fixing temperature based on the detection result by the temperature sensor that is input through the I/O port 119 again. More specifically, as described above, the control unit 7 predicts whether or not the time required for the heating temperature of the fixing unit 35 to reach the fixing temperature is longer than the predetermined time.

In ACT 15 described above, in a case where the control unit 7 predicts that the time required for the heating temperature of the fixing unit 35 to reach the fixing temperature is longer than the predetermined time (No in ACT 15), the process of the MFP 1 is returned to ACT 14 described above. In ACT 14 described above, as described above, the motor driver 121 controls only the motor 139. The motor 139 drives the fixing unit 35.

In ACT 13 described above, in a case where the control unit 7 predicts that the time required for the heating temperature of the fixing unit 35 to reach the fixing temperature is within the predetermined time (Yes in ACT 13), the process of the MFP 1 proceeds to ACT 16. In addition, in ACT 15 described above, in a case where the control unit 7 predicts that the time required for the heating temperature of the fixing unit 35 to reach the fixing temperature is within the predetermined time (Yes in ACT 15), the process of the MFP 1 proceeds to ACT 16.

The case where the control unit 7 predicts that the time required for the heating temperature of the fixing unit 35 to reach the fixing temperature is within the predetermined time is a case where the heating temperature of the fixing unit 35 is higher than the fixing temperature, and, for example, a difference between the heating temperature and the fixing temperature is less than 10% of the fixing temperature.

In ACT 16, the control unit 7 displays a message such as "Copy can be performed" for urging the user to perform an image forming operation on the display panel 9*a* of the operation panel 9. Until the temperature of the fixing unit 35 is actually and completely the fixing temperature after the message urging the user to perform the image forming operation is displayed, a slight time lag may occur. However, the time lag is not of the degree for which the user recognizes undesired standby time. For example, in consideration of the occurrence of the time lag, the display panel 9*a* may display a message such as "Please wait for about 10 seconds".

While an example of the operation for returning the heating temperature of the fixing unit 35 from the erasing temperature to the fixing temperature has been described with reference to FIG. 10, also in a case where the heating temperature of the fixing unit 35 is returned from the discoloring temperature to the fixing temperature, the MFP 1 performs the same returning operations as that illustrated in FIG. 10.

In the MFP 1 according to the first embodiment, the control of switching between the image forming modes of a case where the insufficiency of the residual amounts of one or more coloring materials is detected will be described.

The residual amount detection unit 30 illustrated in FIG. 8 detects a residual amount of the discolorable toner 51*a* of the color BK used in the first image forming station 321*a*, a residual amount of the discolorable toner 51*b* of the color C used in the second image forming station 321*b*, a residual amount of the discolorable toner 51*c* of the color M used in the third image forming station 321*c*, and a residual amount of the discolorable toner 51*d* of the color Y used in the fourth image forming station 321*d*. In addition, the residual amount detection unit 30 detects a residual amount of the toner 61*a* of the color BK used in the fifth image forming station 322*a*, a residual amount of the toner 61*b* of the color C used in the sixth image forming station 322*b*, a residual amount of the toner 61*c* of the color M used in the seventh image forming station 322*c*, and a residual amount of the toner 61*d* of the color Y used in the eighth image forming station 322*d*.

For example, the residual amount detection unit 30 detects that the residual amount of the toner 51*a* of the color BK in the first image forming station 321*a* is less than a predetermined value, the residual amount of the toner 51*b* of the color C in the second image forming station 321*b* is less than a predetermined value, the residual amount of the toner 51*c* of the color M in the third image forming station 321*c* is less than a predetermined value, and the residual amount of the toner 51*d* of the color Y in the fourth image forming station 321*d* is less than a predetermined value. In addition, the residual amount detection unit 30 detects that the residual amount of the toner 61*a* of the color BK in the fifth image forming station 322*a* is less than a predetermined value, the residual amount of the toner 61*b* of the color C in the sixth image forming station 322*b* is less than a predetermined value, the residual amount of the toner 61*c* of the color M in the seventh image forming station 322*c* is less than a predetermined value, and the residual amount of the toner 61*d* of the color Y in the eighth image forming station 322*d* is less than a predetermined value. In other words, the residual amount detection unit 30 detects the insufficiency of the residual amounts of the discolorable toners 51*a* to 51*d* of the colors and the residual amounts of the non-discolorable toners 61*a* to 61*d* of the colors in the first to eighth image forming stations 321*a* to 321*d* and 322*a* to 322*d*.

The MFP 1 can selectively perform the first to third image forming modes. The first image forming mode, as described above, is an image forming mode for printing a full-color image on a sheet in which the MFP 1 forms a full-color image by using the discolorable toners 51*a* to 51*d*. The second image forming mode, as described above, is an image forming mode for printing a full-color image on a sheet in which the MFP 1 forms a full-color image by using the non-discolorable toners 61*a* to 61*d*. The third image forming mode, as described above, is an image forming mode for printing a full-color image on a sheet in which the MFP 1 forms a full-color image by using some of the discolorable toners 51*a* to 51*d* and some of the non-discolorable toners 61*a* to 61*d* in combination.

For example, the user selects the full-color printing using discolorable toner that is the first image forming mode by operating the operation panel 9. In addition, when the user operates the start key arranged on the operation panel 9, the MPU 79 controls image formation for the full-color printing using the discolorable toners 51*a* to 51*d* of four colors based on the image data. The image forming unit 3 performs full-color image formation using the discolorable four-color toners 51*a* to 51*d* under the control of the MPU 79 based on the image data. More specifically, the first to fourth image forming stations 321*a* to 321*d* form a full-color image by using the discolorable toners 51*a* to 51*d* based on the image data.

For the full-color image formed on this sheet, the discolorable toners 51*a* to 51*d* are used, and accordingly, by heating the full-color image to the discoloring temperature using the fixing unit 35, the image can be discolored. In addition, by heating the full-color image formed on the sheet to the erasing temperature using the fixing unit 35, the image can be erased.

As described above, in a case where the user selects the first image forming mode, and the MFP 1 performs the full-color printing using the discolorable toner in accordance with the user's selection, the MPU 79 controls a first sheet discharging process. More specifically, the MPU 79 controls the first sheet discharging process such that the sheet on which the image is formed is discharged to the second sheet discharge tray T12.

For example, the user selects the full-color printing using non-discolorable toner that is the second image forming mode by operating the operation panel 9. In addition, when the user operates the start key arranged on the operation panel 9, the MPU 79 controls image formation for the full-color printing using the non-discolorable toners 61*a* to 61*d* of four colors based on the image data. The image forming unit 3 performs full-color image formation using the non-discolorable four-color toners 61*a* to 61*d* under the control of the MPU 79. More specifically, the fifth to eighth image forming stations 322*a* to 322*d* form a full-color image by using the non-discolorable toners 61*a* to 61*d* based on the image data.

As described above, in a case where the user selects the second image forming mode, and the MFP 1 performs the full-color printing using the non-discolorable toner in accordance with the user's selection, the MPU 79 controls the first sheet discharging process. The MPU 79 controls the first sheet discharging process such that the sheet on which the image is formed is discharged to the first sheet discharge tray T11.

In addition, in a case where a residual amount of at least one of the toners 51*a* to 51*d* and 61*a* to 61*d* is insufficient, the MFP 1 performs image formation for the full-color printing using the discolorable toner and the non-discolorable toner in combination that is the third image forming mode. More specifically, the MPU 79 determines that at least one of the toners 51*a* to 51*d* and 61*a* to 61*d* is insufficient based on the residual amount detection result by the residual amount detection unit 30. In a case where the residual amount of at least one toner is determined to be insufficient, the MPU 79 selects the third image forming mode as the image forming mode of the MFP 1. In other words, the MPU 79 sets the image forming mode of the MFP 1 to the third image forming mode. The MPU 79 controls image formation for the full-color printing using the discolorable toner and non-discolorable toner in combination based on the image data. The image forming unit 3 performs full-color image formation using the discolorable toner and the non-discolorable toner in combination based on the image data under the control of the MPU 79.

For example, in a case where the user selects the first image forming mode, but the insufficiency of one or more toners out of the toners 51*a* to 51*d* that are necessary for the full-color printing using the discolorable toner is detected by the residual amount detection unit 30, the MPU 79 selects the third image forming mode, thereby switching the image forming mode of the MFP 1 from the first image forming mode selected by the user to the third image forming mode.

In addition, for example, in a case where the user selects the second image forming mode, but the insufficiency of the residual amounts of one or more toners out of the toners 61*a* to 61*d* that are necessary for the full-color printing using the non-discolorable toners is detected by the residual amount detection unit 30, the MPU 79 selects the third image forming mode, thereby switching the image forming mode of the MFP 1 from the second image forming mode selected by the user to the third image forming mode.

Furthermore specifically, for example, in a case where the residual amount of the toner 51*a* is detected to be less than a predetermined value by the residual amount detection unit 30, the residual amount of the coloring material 61*a* of the color corresponding to the toner 51*a* is detected to be a predetermined value or more by the residual amount detection unit 30, and the first image forming mode is selected by the user, the MPU 79 controls image formation for the full-color printing using the toner 61*a* corresponding to the toner 51*a* and the toners 51*b* to 51*d* in combination. The image forming unit 3 performs full-color image formation using the coloring materials 61*a* and 51*b* to 51*d* by the fifth image forming station 322*a* and the second to fourth image forming stations 321*b* to 321*d*.

In a case where the user selects the first image forming mode, but the MFP 1 performs image formation of the third image forming mode, the MPU 79 controls the second sheet discharging process. More specifically, the MPU 79 controls the second sheet discharging process such that the sheet on which an image is formed is discharged to the first sheet discharge tray T11. As the sheet discharge destination is switched from the second sheet discharge tray T12 to the first sheet discharge tray T11, the user can determine that the image is formed on the sheet by the full-color printing of the third image forming mode.

In addition, the MPU 79 may output first switching information that represents the image formation of the third image forming mode replacing the first image forming mode, for example, to the display unit 9*a* before the image formation of the third image forming mode. The display unit 9*a* displays a guide representing that the full-color printing of the third image forming mode that replaces the full-color printing of the first image forming mode based on the first switching information is performed.

In addition, the MPU 79 may output second switching information that represents that the image formation of the third image forming mode replacing the first image forming mode is performed to the display unit 9*a* after the image formation of the third image forming mode is performed. The display unit 9*a* displays a guide representing that the full-color printing of the third image forming mode that replaces the full-color printing of the first image forming mode based on the second switching information is performed.

Furthermore, the MPU 79 controls the image formation of the image forming unit 3 such that information representing the full-color printing of the third image forming mode, for example, a mark is printed on a sheet together with an image that is a printing target. Alternatively, the MPU 79 controls the image formation of the image forming unit 3 such that information representing the full-color printing of the third image forming mode replacing the first image forming mode, for example, a mark is printed on a sheet together with an image that is the printing target. By being controlled by the MPU 79, the image forming unit 3 performs an image formation in which the mark is printed together with the image that is the printing target.

In addition, for example, in a case where the residual amounts of the toners 51*a* and 51*b* are detected to be less than a predetermined value by the residual amount detection unit 30, the residual amounts of the coloring materials 61*a* and 61*b* of colors corresponding to the toners 51*a* and 51*b* are detected to be a predetermined value or more by the residual amount detection unit 30, and the first image forming mode is selected by the user, the MPU 79 controls the image formation for the full-color printing using the toners 61*a* and 61*b* of colors corresponding to the toners 51*a* and 51*b* and the toners 51*c* to 51*d* in combination. The image forming unit 3 performs the full-color image formation using the toners 61*a*, 61*b*, 51*c*, and 51*d* by the fifth image forming station 322*a*, the sixth image forming station 322*b*, the third image forming station 321*c*, and the fourth image forming station 321*d*.

As described above, in a case where the user selects the first image forming mode, but the MFP 1 performs image formation of the third image forming mode, the MPU 79 controls the second sheet discharging process. The MPU 79 controls the second sheet discharging process such that the sheet on which an image is formed is discharged to the first sheet discharge tray T11. As the sheet discharge destination is switched from the second sheet discharge tray T12 to the first sheet discharge tray T11, the user can determine that the image is formed on the sheet by the full-color printing of the third image forming mode.

In addition, the MPU 79 may output first switching information that represents the image formation of the third image forming mode replacing the first image forming mode, for example, to the display unit 9*a* before the image formation of the third image forming mode. The display unit 9*a* displays a guide representing that the full-color printing of the third image forming mode that replaces the full-color printing of the first image forming mode based on the first switching information is performed.

In addition, the MPU 79 may output second switching information that represents that the image formation of the third image forming mode replacing the first image forming mode is performed, for example, to the display unit 9*a* after the image formation of the third image forming mode is performed. The display unit 9*a* displays a guide representing that the full-color printing of the third image forming mode that replaces the full-color printing of the first image forming mode based on the second switching information is performed.

Furthermore, the MPU 79 controls the image formation of the image forming unit 3 such that information representing the full-color printing of the third image forming mode, for example, a mark is printed on a sheet together with an image that is a printing target. Alternatively, the MPU 79 controls the image formation of the image forming unit 3 such that information representing the full-color printing of the third image forming mode replacing the first image forming mode, for example, a mark is printed on a sheet together with an image that is the printing target. By being controlled by the MPU 79, the image forming unit 3 performs an image formation in which the mark is printed together with the image that is the printing target.

In addition, for example, in a case where the residual amount of the toner 61*a* is detected to be less than a predetermined value by the residual amount detection unit 30, the residual amount of the coloring material 51*a* of the color corresponding to the toner 61*a* is detected to be a predetermined value or more by the residual amount detection unit 30, and the second image forming mode is selected by the user, the MPU 79 controls the image formation for the full-color printing using the toner 51*a* of color corresponding to the toner 61*a* and the toners 61*b* to 61*d* in combination. The image forming unit 3 performs full-color image formation using the coloring materials 51*a* and 61*b* to 61*d* by the first image forming station 321*a* and the sixth to eighth image forming stations 322*b* to 322*d*.

In a case where the user selects the second image forming mode, but the MFP 1 performs image formation of the third image forming mode, the MPU 79 controls the second sheet discharging process. The MPU 79 controls the second sheet discharging process such that the sheet on which an image is formed is discharged to the second sheet discharge tray T12. As the sheet discharge destination is switched from the first sheet discharge tray T11 to the second sheet discharge tray T12, the user can determine that the image is formed on the sheet by the full-color printing of the third image forming mode.

In addition, the MPU 79 may output third switching information that represents the image formation of the third image forming mode replacing the second image forming mode, for example, to the display unit 9*a* before the image formation of the third image forming mode. The display unit 9*a* displays a guide representing that the full-color printing of the third image forming mode that replaces the full-color printing of the second image forming mode based on the third switching information is performed.

In addition, the MPU 79 may output fourth switching information that represents that the image formation of the third image forming mode replacing the second image forming mode is performed, for example, to the display unit 9*a* after the image formation of the third image forming mode is performed. The display unit 9*a* displays a guide representing that the full-color printing of the third image forming mode that replaces the full-color printing of the second image forming mode based on the fourth switching information is performed.

Furthermore, the MPU 79 controls the image formation of the image forming unit 3 such that information representing the full-color printing of the third image forming mode, for example, a mark is printed on a sheet together with an image that is a printing target.

Alternatively, the MPU 79 controls the image formation of the image forming unit 3 such that information representing the full-color printing of the third image forming mode replacing the second image forming mode, for example, a mark is printed on a sheet together with an image that is the printing target. By being controlled by the MPU 79, the image forming unit 3 performs an image formation in which the mark is printed together with the image that is the printing target.

In addition, for example, in a case where the residual amounts of the toners 61*a* and 61*b* are detected to be less than a predetermined value by the residual amount detection unit 30, the residual amounts of the coloring materials 51*a* and 51*b* of colors (for example, similar colors) corresponding to the toners 61*a* and 61*b* are detected to be a predetermined value or more by the residual amount detection unit 30, and the second image forming mode is selected by the user, the MPU 79 controls the image formation for the full-color printing using the toners 51*a* and 51*b* of colors corresponding to the toners 61*a* and 61*b* and the toners 61*c* and 61*d* in combination. The image forming unit 3 performs the full-color image formation using the toners 51*a*, 51*b*, 61*c*, and 61*d* by the first image forming station 321*a*, the second image forming station 321*b*, the seventh image forming station 322*c*, and the eighth image forming station 322*d*.

As described above, in a case where the user selects the second image forming mode, but the MFP 1 performs image formation of the third image forming mode, the MPU 79 controls the second sheet discharging process. The MPU 79 controls the second sheet discharging process such that the sheet on which an image is formed is discharged to the second sheet discharge tray T12. As the sheet discharge destination is switched from the first sheet discharge tray T11 to the second sheet discharge tray T12, the user can determine that the image is formed on the sheet by the full-color printing of the third image forming mode.

In addition, the MPU 79 may output third switching information that represents the image formation of the third image forming mode replacing the second image forming mode, for example, to the display unit 9*a* before the image formation of the third image forming mode. The display unit 9*a* displays a guide representing that the full-color printing of the third image forming mode that replaces the full-color printing of the second image forming mode based on the third switching information is performed.

In addition, the MPU 79 may output fourth switching information that represents that the image formation of the third image forming mode replacing the second image forming mode is performed, for example, to the display unit 9*a* after the image formation of the third image forming mode is performed. The display unit 9*a* displays a guide representing that the full-color printing of the third image forming mode that replaces the full-color printing of the second image forming mode based on the fourth switching information is performed.

Furthermore, the MPU 79 controls the image formation of the image forming unit 3 such that information representing the full-color printing of the third image forming mode, for example, a mark is printed on a sheet together with an image that is a printing target.

Alternatively, the MPU 79 controls the image formation of the image forming unit 3 such that information representing the full-color printing of the third image forming mode replacing the second image forming mode, for example, a mark is printed on a sheet together with an image that is the printing target. By being controlled by the MPU 79, the image forming unit 3 performs an image formation in which the mark is printed together with the image that is the printing target.

Accordingly, even when the residual amount of one or more toners out of the discolorable toners 51*a* to 51*d* and the non-discolorable toners 61*a* to 61*d* is insufficient, the MFP 1 can form an image by using one or more toners (for example, toner of a similar color) of which the residual amounts are not insufficient, whereby a decrease in the processing efficiency can be prevented.

In a case where the MFP 1 performs the full-color printing of the third image forming mode, the MPU 79 may perform an image correction in accordance with the characteristics of the colors of used toners. For example, the discolorable toners 51*b* to 51*d* of colors C, M, and Y and the non-discolorable toners 61*b* to 61*d* of colors C, M, and Y do not have completely the same colors. In a case where the colors of the discolorable toners and the non-discolorable toners are not completely the same, the MPU 79 maintains the color information of the discolorable toners 51*b* to 51*d* of the colors C, M, and Y and the non-discolorable toners 61*b* to 61*d* of the colors C, M, and Y and performs an image correction based on the color information.

Figure 4:
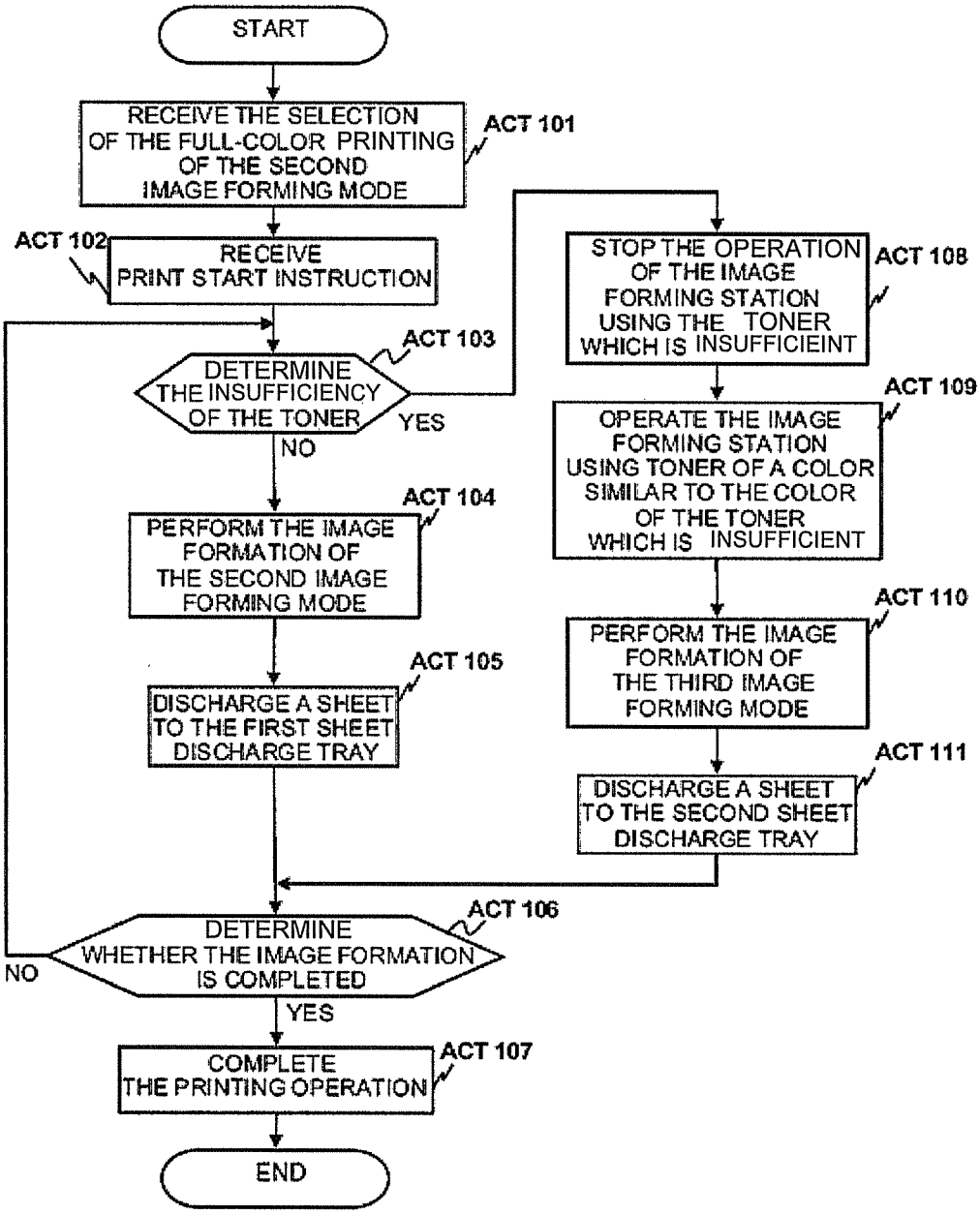
FIG. 4 is a flowchart illustrating an automatic switching process from the full-color printing of the second image forming mode to the full-color printing of the third image forming mode in the image forming apparatus according to the first embodiment.

With reference to FIG. 4, an example of an automatic switching process from the full-color printing of the second image forming mode to the full-color printing of the third image forming mode will be described. FIG. 4 is a flowchart illustrating the automatic switching process from the full-color printing of the second image forming mode to the full-color printing of the third image forming mode in the MFP 1.

For example, the user selects the full-color printing that is the second image forming mode using non-discolorable toners by operating the display screen of the display unit 9*a* of the operation panel 9. As illustrated in FIG. 4, in ACT 101, when the MPU 79 determines that the operation panel 9 receives the selection of the full-color printing of the second image forming mode, the MPU 79 sets the image forming mode of the MFP 1 to the second image forming mode.

The user makes a print start instruction by operating the start key arranged on the operation panel 9 in the second image forming mode. In ACT 102, the MPU 79 determines that the start key receives a user's operation.

In ACT 103, the residual amount detection unit 30 detects whether the residual amounts of the toners 51*a* to 51*d* and 61*a* to 61*d* are less than a predetermined value. In a case where the MPU 79 determines that the residual amounts of the non-discolorable toners 61*a* to 61*d* are not less than the predetermined value based on the detection result by the residual amount detection unit 30 (No in ACT 103), the process of the MFP 1 proceeds to ACT 104.

In ACT 104, the MPU 79 controls the image formation for the full-color printing using the non-discolorable toners 61*a* to 61*d*. The image forming unit 3, as illustrated in FIG. 2, performs full-color image formation using the coloring materials 61*a* to 61*d* by the fifth to eighth image forming stations 322*a* to 322*d* under the control of the MPU 79.

In ACT 105, the MPU 79 controls the first sheet discharging process such that the sheet on which an image is formed is discharged to the first sheet discharge tray T11. As illustrated in FIG. 2, the sheet on which the image is formed is discharged to the first sheet discharge tray T11 under the control of the MPU 79 for the first sheet discharging process.

In ACT 106, the MPU 79, for example, determines whether or not image formation corresponding to the number of sheets set by the user in advance is completed each time when the sheet is discharged. In a case where the MPU 79 determines that the image formation corresponding to the set number of sheets is not completed (No in ACT 106), the process of the MFP 1 is returned to ACT 103 described above. The MFP 1 repeats the process of ACT 103 to ACT 106 described above until the image formation corresponding to the set number of sheets is completed. In a case where the MPU 79 determines that the image formation corresponding to the set number of sheets is completed (Yes in ACT 106), the process of the MFP 1 proceeds to ACT 107.

In ACT 107, the MPU 79 ends the control for the full-color printing of the second image forming mode. Accordingly, the MFP 1 ends the printing operation according to the second image forming mode.

In ACT 103 described above, in a case where the MPU 79 determines that the residual amount of at least one of the non-discolorable toners 61*a* to 61*d* is less than the predetermined value (Yes in ACT 103), the process of the MFP 1 proceeds to ACT 108.

In ACT 108, the MPU 79 stops the operation of the image forming station using the non-discolorable toner of which the residual amount is less than the predetermined value. As illustrated in FIG. 3, for example, in a case where the residual amount of the toner 61*a* out of the non-discolorable toners 61*a* to 61*d* is insufficient, the MPU 79 stops the operation of the sixth image forming station 322*b*.

In ACT 109, the MPU 79 operates the image forming station using the discolorable toner corresponding to the non-discolorable toner of which the residual amount is less than the predetermined value by replacing the non-discolorable toner of which the residual amount is less than the predetermined value. For example, the MPU 79 operates the second image forming station 321*b* that uses the discolorable toner 51*b* of the similar color by replacing the toner 61*b*.

In ACT 110, the MPU 79 controls the image formation for the full-color printing of the third image forming mode using non-discolorable toners and discolorable toners in combination. The image forming unit 3 performs the image formation for the full-color printing of the third image forming mode by an image forming station using the discolorable toner of a color corresponding to the non-discolorable toner of which the residual amount is less than the predetermined value and image forming stations using non-discolorable toners of which the residual amounts are not less than the predetermined value under the control of the MPU 79.

In ACT 111, as illustrated in FIG. 3, the MPU 79 controls the second sheet discharging process such that the sheet on which an image is formed is discharged to the second sheet discharge tray T12. As illustrated in FIG. 3, the sheet on which the image is formed is discharged to the second sheet discharge tray T12 in accordance with the MPU 79. In other words, the MPU 79 switches the discharge destination of the sheet on which the image is formed from the first sheet discharge tray T11 to the second sheet discharge tray T12. When the sheet on which the image is formed is discharged to the second sheet discharge tray T12, the process of the MFP 1 is returned to ACT 106 described above.

In ACT 106 described above, as described above, the MPU 79 determines whether or not the image formation corresponding to the set number of sheets is completed. In a case where the MPU 79 determines that the image formation corresponding to the set number of sheets is not completed (No in ACT 106), the process of the MFP 1 is returned to ACT 103. The MFP 1 repeats the process of ACT 103 and ACT 108 to ACT 106 described above until the image formation corresponding to the set number of sheets is completed.

Figure 5:
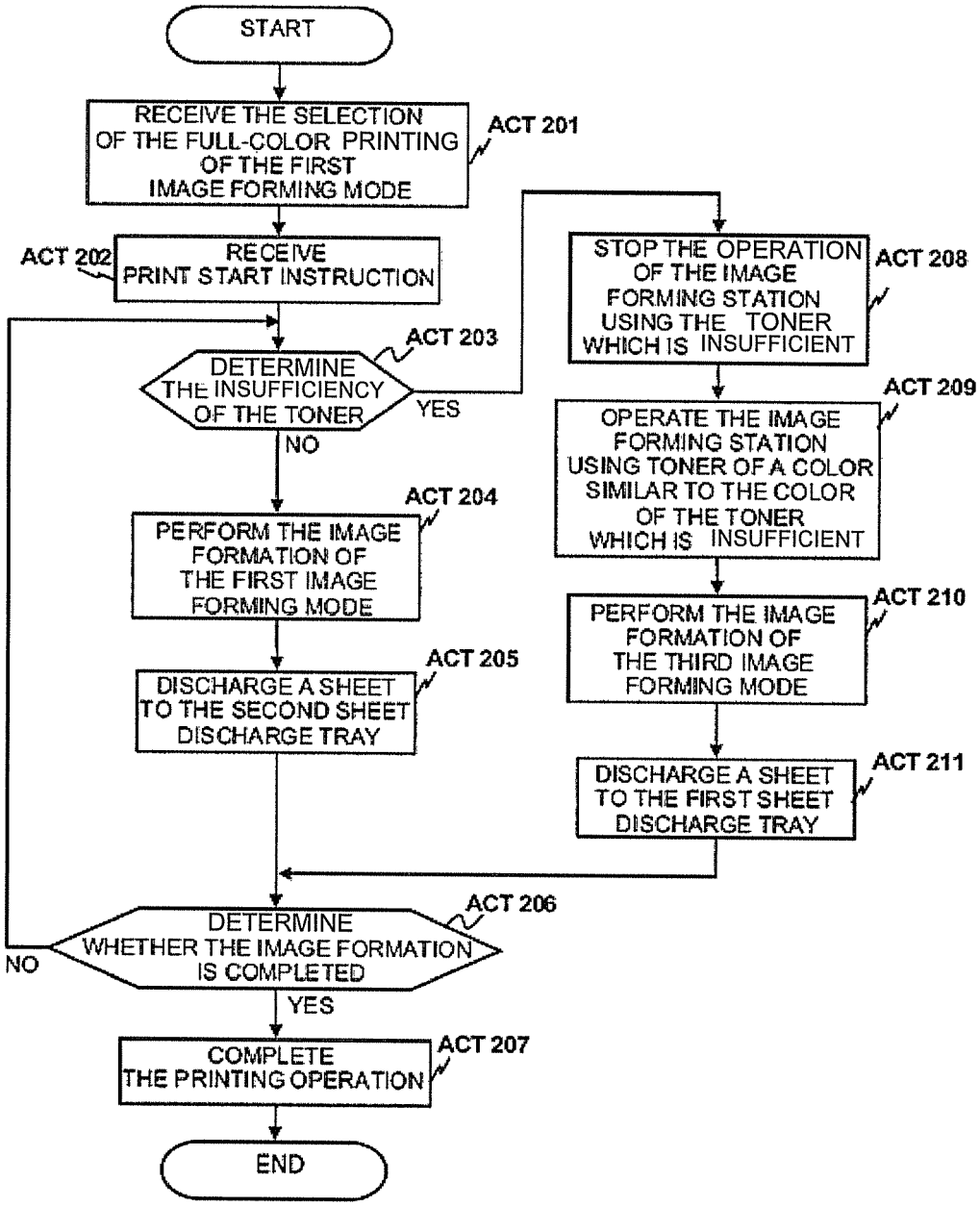
FIG. 5 is a flowchart illustrating an automatic switching process from a full-color printing of a first image forming mode to the full-color printing of the third image forming mode in the image forming apparatus according to the first embodiment.

With reference to FIG. 5, an example of an automatic switching process from the full-color printing of the first image forming mode to the full-color printing of the third image forming mode will be described. FIG. 5 is a flowchart illustrating the automatic switching process from the full-color printing of the first image forming mode to the full-color printing of the third image forming mode in the MFP 1.

For example, the user selects the full-color printing of the first image forming mode by operating the display screen of the display unit 9*a* of the operation panel 9. As illustrated in FIG. 5, in ACT 201, when the MPU 79 determines that the operation panel 9 receives the selection of the full-color printing of the first image forming mode by the user, the MPU 79 sets the image forming mode of the MFP 1 to the first image forming mode.

The user makes a print start instruction by operating the start key arranged on the operation panel 9 in the first image forming mode. In ACT 202, the MPU 79 determines that the start key receives a user's operation.

In ACT 203, the residual amount detection unit 30 detects whether the residual amounts of the toners 51*a* to 51*d* and 61*a* to 61*d* are less than the predetermined value. In a case where the MPU 79 determines that the residual amounts of the discolorable toners 51*a* to 51*d* are not less than the predetermined value based on the detection result by the residual amount detection unit 30 (No in ACT 203), the process of the MFP 1 proceeds to ACT 204.

In ACT 204, the MPU 79 controls the image formation for the full-color printing using the discolorable toners. The image forming unit 3 performs full-color image formation using the toners 51*a* to 51*d* by the first to fourth image forming stations 321*a* to 321*d* under the control of the MPU 79.

In ACT 205, the MPU 79 controls the first sheet discharging process such that the sheet on which an image is formed is discharged to the second sheet discharge tray T12.

In ACT 206, the MPU 79, for example, determines whether or not image formation corresponding to the number of sheets set by the user in advance is completed each time when the sheet is discharged. In a case where the MPU 79 determines that the image formation corresponding to the set number of sheets is not completed (No in ACT 206), the process of the MFP 1 is returned to ACT 203 described above. The MFP 1 repeats the process of ACT 203 to ACT 206 described above until the image formation corresponding to the set number of sheets is completed. In a case where the MPU 79 determines that the image formation corresponding to the set number of sheets is completed (Yes in ACT 206), the process of the MFP 1 proceeds to ACT 207.

In ACT 207, the MPU 79 ends the control for the full-color printing of the first image forming mode. Accordingly, the MFP 1 ends the printing operation according to the first image forming mode.

In ACT 203 described above, in a case where the MPU 79 determines that the residual amount of at least one of the discolorable toners 51*a* to 51*d* is less than the predetermined value (Yes in ACT 203), the process of the MFP 1 proceeds to ACT 208.

In ACT 208, the MPU 79 stops the operation of the image forming station using the discolorable toner of which the residual amount is less than the predetermined value. For example, in a case where the residual amount of the toner 51*b* out of the discolorable toners 51*a* to 51*d* is insufficient, the MPU 79 stops the operation of the second image forming station 321*b*.

In ACT 209, the MPU 79 uses a non-discolorable toner of a color corresponding to the discolorable toner of which the residual amount is less than the predetermined value by replacing the discolorable toner of which the residual amount is less than the predetermined value. For example, the MPU 79 operates the sixth image forming station 321*b* that uses the non-discolorable toner 61*b* of the similar color by replacing the toner 51*b*.

In ACT 210, the MPU 79 controls the image formation for the full-color printing of the third image forming mode using discolorable toners and non-discolorable toners in combination. The image forming unit 3 performs the image formation for the full-color printing using the discolorable toners and non-discolorable toners in combination by an image forming station using the non-discolorable toner of a color corresponding to the discolorable toner of which the residual amount is less than the predetermined value and image forming stations using discolorable toners of which the residual amounts are not less than the predetermined value under the control of the MPU 79.

In ACT 211, the MPU 79 controls the second sheet discharging process such that the sheet on which an image is formed is discharged to the first sheet discharge tray T11. In other words, the MPU 79 switches the discharge destination of the sheet on which the image is formed from the first sheet discharge tray T11 to the second sheet discharge tray T12. When the sheet on which the image is formed is discharged to the first sheet discharge tray T11, the operation of the MFP 1 is again returned to ACT 206 described above.

In ACT 206 described above, as described above, the MPU 79 determines whether or not the image formation corresponding to the set number of sheets is completed. In a case where the MPU 79 determines that the image formation corresponding to the set number of sheets is not completed (No in ACT 206), the process of the MFP 1 is returned to ACT 203 described above. The MFP 1 repeats the process of ACT 203 and ACT 208 to ACT 206 described above until the image formation corresponding to the set number of sheets is completed.

With reference to FIGS. 4 and 5, the switching process from the full-color printing of the second image forming mode to the full-color printing of the third image forming mode and the switching process from the full-color printing of the first image forming mode to the full-color printing of the third image forming mode are described. However, the image forming mode switching process of the MFP 1 according to the first embodiment is not limited to the switching processes illustrated in FIGS. 4 and 5.

The MFP 1 according to the first embodiment further has a fourth image forming mode in which a monochrome image is printed on a sheet by forming the monochrome image using a discolorable toner and a fifth image forming mode in which a monochrome image is printed on a sheet by forming the monochrome image using the non-discolorable toner. The MFP 1 can realize a switching process from the monochrome printing of the fifth image forming mode to the monochrome printing of the fourth image forming mode and a switching process from the monochrome printing of the fourth image forming mode to the monochrome printing of the fifth image forming mode.

For example, in a case where the insufficiency of the residual amount of the non-discolorable toner 61*a* is detected by the residual amount detection unit 30, the MFP 1 may perform image formation for a monochrome printing by using the toner 51*a* of a color corresponding to the toner 61*a* by switching from the monochrome printing of the fifth image forming mode to the monochrome printing of the fourth image forming mode. In addition, in a case where the insufficiency of the residual amount of the discolorable toner 51*a* is detected by the residual amount detection unit 30, the MFP 1 can perform image formation for a monochrome printing by using the toner 61*a* of a color corresponding to the toner 51*a* by switching from the monochrome printing of the fourth image forming mode to the monochrome printing of the fifth image forming mode.

With reference to FIG. 4, the control of the sheet discharging process has been described in which the sheet on which an image is formed is discharged to the first sheet discharge tray T11 in the case of the second image forming mode, and the sheet on which an image is formed is discharged to the second sheet discharge tray T12 in the case of the third image forming mode. In addition, with reference to FIG. 5, the control of the sheet discharging process has been described in which the sheet on which an image is formed is discharged to the second sheet discharge tray T12 in the case of the first image forming mode, and the sheet on which an image is formed is discharged to the first sheet discharge tray T11 in the case of the third image forming mode. However, the sheet discharging control of the MFP 1 is not limited to the sheet discharging control described with reference to FIGS. 4 and 5.

For example, in the case of the first or second image forming mode, the MPU 79 may control the first sheet discharging process such that the sheet is discharged to the first sheet discharge tray T11. In addition, in the case of the third image forming mode, the MPU 79 may control the second sheet discharging process such that the sheet is discharged to the second sheet discharge tray T12. By controlling the sheet discharging process as described above, when a sheet is discharged to the second sheet discharge tray T12, the user can recognize that the full-color printing of the third image forming mode is performed.

In addition, in the MFP 1 according to the first embodiment, the user can intentionally selects a full-color printing of the third image forming mode by operating the display screen of the display unit 9*a* arranged on the operation panel 9.

In a case where the user intentionally selects the full-color printing of the third image forming mode, the user can designate a combination of discolorable toners and non-discolorable toners by operating the display screen of the display unit 9*a* of the operation panel 9.

For example, when the user designates the non-discolorable toner 61*a* and the discolorable toners 51*b* to 51*d*, and also the user directs the start of a printing operation by operating the start key arranged on the operation panel 9, the MPU 79 controls the image formation for the full-color printing of the third image forming mode based on the image data. The image forming unit 3 performs full-color image formation using the non-discolorable toner 61*a* and the discolorable toners 51*b* to 51*d* in combination based on the image data under the control of the MPU 79.

By performing the erasing process for the image formed by using the non-discolorable toner 61*a* and the discolorable toners 51*b* to 51*d*, portions of the image according to the coloring materials 51*b* to 51*d* other than the toner 61*a* can be erased.

In addition, when the user designates the discolorable toner 51*a* and the non-discolorable toners 61*b* to 61*d*, and also the user directs the start of a printing operation by operating the start key arranged on the operation panel, the MPU 79 controls the image formation for the full-color printing of the third image forming mode using the discolorable toner 51*a* and the non-discolorable toners 61*b* to 61*d* based on the image data. The image forming unit 3 performs full-color image formation using the discolorable toner 51*a* and the non-discolorable toners 61*b* to 61*d* based on the image data under the control of the MPU 79.

By performing the erasing process for the image formed by using the discolorable toner 51*a* and the non-discolorable toners 61*b* to 61*d*, portions of the image according to the toner 51*a* other than the coloring materials 61*b* to 61*d* can be erased.

In addition, in a case where the insufficiency of the residual amount of one or more toners of the discolorable toners 51*a* to 51*d* is detected by the residual amount detection unit 30, the MFP 1 may switch the full-color printing of the first image forming mode using the discolorable toners 51*a* to 51*d* to the full-color printing of the second image forming mode using the non-discolorable toners 61*a* to 61*d*.

As described above, in a case where the insufficiency of the residual amount of one or more toners of the non-discolorable toners 61*a* to 61*d* is detected by the residual amount detection unit 30, the MFP 1 may switch the full-color printing of the second image forming mode using the non-discolorable toners 61*a* to 61*d* to the full-color printing of the first image forming mode using the discolorable toners 51*a* to 51*d*.

In addition, in a case where the insufficiency of the residual amounts of three or more toners of the discolorable toners 51*a* to 51*d* is detected by the residual amount detection unit 30, the MFP 1 may switch the full-color printing of the first image forming mode using the discolorable toners 51*a* to 51*d* to the full-color printing of the second image forming mode using the non-discolorable toners 61*a* to 61*d*. Furthermore, in a case where the insufficiency of the residual amounts of less than three toners out of the discolorable toners 51*a* to 51*d* is detected by the residual amount detection unit 30, the MFP 1 may switch the full-color printing of the first image forming mode using the discolorable toners 51*a* to 51*d* to the full-color printing of the second image forming mode using the non-discolorable toners 61*a* to 61*d*.

In addition, in a case where the insufficiency of the residual amounts of three or more coloring materials of the non-discolorable toners 61*a* to 61*d* is detected by the residual amount detection unit 30, the MFP 1 may switch the full-color printing of the second image forming mode using the non-discolorable toners 61*a* to 61*d* to the full-color printing of the first image forming mode using the discolorable toners 51*a* to 51*d*. Furthermore, in a case where the insufficiency of the residual amounts of less than three coloring materials out of the toners 61*a* to 61*d* is detected by the residual amount detection unit 30, the MFP 1 may switch the full-color printing of the second image forming mode using the non-discolorable coloring materials 61*a* to 61*d* to the full-color printing of the third image forming mode using discolorable toners and non-discolorable toners in combination.

Each one of the discolorable coloring materials, for example, toner or ink, as described above, contains a coloring compound, a developing agent, a binder resin, and the like. When the coloring material that is in the state in which the coloring compound develops a color by receiving the action of the developing agent is heated to a predetermined temperature, the binder resin is softened, and it becomes easy for mainly the developing agent to move from the inside of the binder resin to the surface, whereby the developing agent moves or diffuses on the sheet. Accordingly, the coloring compound does not receive the action of the developing agent, whereby the color of the coloring compound cannot be recognized by the user.

The coloring compound is a precursor compound of the pigment that forms the image. As the coloring compound, for example, it is preferable to use an electron donor organic material such as leukoauramines, diarylphthalides, polyarylcarbinols, arylauramines, arylauramines, rhodamine B lactams, indolines, spiropyrans, or fluorans.

The developing agent is a compound that develops the color of the coloring compound based on an interaction (mainly, transmission/reception of electrons or protons) with the coloring compound. As the developing agent, for example, it is preferable to use phenols, phenol metal salts, carboxylic acid metal salts, benzophenones, sulfonic acid, sulfonate, phosphorus acids, phosphate metal salts, acidic phosphate ester, acidic phosphate ester metal salts, phosphorous acids, or phosphorous acid metal salts and the like.

The binder resin disperses the coloring compound and the developing agent in the state in which the color is developed. As the binder resin, it is preferable to use a material that is compatible with the coloring compound by being applied with constant heating and does not have affinity to the developing agent.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

an image forming unit configured to selectively perform a first image forming mode in which a color image is formed by using discolorable coloring materials of a plurality of colors, a second image forming mode in which a color image is formed by using non-discolorable coloring materials of a plurality of colors, and a third image forming mode in which a color image is formed by using the discolorable coloring materials of the plurality of colors and the non-discolorable coloring materials of the plurality of colors in combination;

a detection unit configured to detect whether or not residual amounts of the discolorable coloring materials of the plurality of colors and the non-discolorable coloring materials of the plurality of colors are insufficient; and a control unit configured to control color image formation of the third image forming mode by the image forming unit in a case where the detection unit detects insufficiency of a residual amount of the coloring material of at least one color from among the discolorable coloring materials of the plurality of colors or the non-discolorable coloring material of at least one color from among the non-discolorable coloring materials of the plurality of colors, wherein the control unit controls a first sheet discharging process in which a recording medium having a color image formed on the recording medium by performing the first image forming mode or the second image forming mode is discharged and a second sheet discharging process in which a recording medium having a color image formed on the recording medium by performing the third image forming mode is discharged.

2. The image forming apparatus according to claim 1, wherein, in a case where the image forming mode is switched from the first image forming mode or the second image forming mode to the third image forming mode, the control unit switches the sheet discharging process from the first sheet discharging process to the second sheet discharging process.

3. The image forming apparatus according to claim 2, further comprising first and second sheet discharge trays that hold recording media, on which color images are formed, that are discharged, wherein the control unit controls the first sheet discharging process such that the recording medium on which the color image is formed by performing the first image forming mode is discharged to the second sheet discharge tray, and the recording medium on which the color image is formed by performing the second image forming mode is discharged to the first sheet discharge tray, and wherein the control unit controls the second sheet discharging process such that the recording medium on which the color image is formed according to the third image forming mode switched from the first image forming mode is discharged to the first sheet discharge tray, and the recording medium on which the color image is formed by performing the third image forming mode switched from the second image forming mode is discharged to the second sheet discharge tray.

4. The image forming apparatus according to claim 1, wherein, in a case where the image forming mode is switched from the first image forming mode or the second image forming mode to the third image forming mode, the control unit outputs switching information that represents the switching to the third image forming mode.

5. The image forming apparatus according to claim 4, further comprising a display unit, wherein the control unit controls the display unit such that a guide relating to the switching of the image forming mode is displayed based on the switching information.

6. The image forming apparatus according to claim 4, wherein the control unit controls the color image formation of the third image forming mode by the image forming unit such that the switching information is formed on the recording medium together with the color image.

* * * * *